US007011394B2

(12) United States Patent
Cabal et al.

(10) Patent No.: US 7,011,394 B2
(45) Date of Patent: Mar. 14, 2006

(54) LIQUID DROP EMITTER WITH REDUCED SURFACE TEMPERATURE ACTUATOR

(75) Inventors: Antonio Cabal, Webster, NY (US); John A. Lebens, Rush, NY (US); Stephen F. Pond, Oakton, VA (US)

(73) Assignee: Eastman Kodak Company, Rochester, NY (US)

( * ) Notice: Subject to any disclaimer, the term of this patent is extended or adjusted under 35 U.S.C. 154(b) by 136 days.

(21) Appl. No.: 10/650,873

(22) Filed: Aug. 28, 2003

(65) Prior Publication Data

US 2005/0046671 A1 Mar. 3, 2005

(51) Int. Cl.
*B41J 2/04* (2006.01)

(52) U.S. Cl. ..... 347/54; 347/56

(58) Field of Classification Search ..... 347/20, 347/54, 56, 61, 63–64, 65, 67; 60/527–529; 310/306–307; 337/139–141
See application file for complete search history.

(56) References Cited

U.S. PATENT DOCUMENTS

| | | | | |
|---|---|---|---|---|
| 3,747,120 | A | 7/1973 | Stemme | 347/70 |
| 3,946,398 | A | 3/1976 | Kyser et al. | 347/70 |
| 4,296,421 | A | 10/1981 | Hara et al. | 347/48 |
| 5,599,695 | A | 2/1997 | Pease et al. | 435/91.1 |
| 5,771,882 | A | 6/1998 | Psaros et al. | 128/203.12 |
| 5,812,163 | A | 9/1998 | Wong | 347/68 |
| 5,902,648 | A | 5/1999 | Naka et al. | 427/558 |
| 6,067,797 | A | 5/2000 | Silverbrook | 60/528 |
| 6,087,638 | A | 7/2000 | Silverbrook | 219/540 |
| 6,180,427 | B1 | 1/2001 | Silverbrook | 347/56 |
| 6,239,821 | B1 | 5/2001 | Silverbrook | 347/54 |
| 6,243,113 | B1 | 6/2001 | Silverbrook | 347/54 |
| 6,254,793 | B1 | 7/2001 | Silverbrook | 216/27 |
| 6,274,056 | B1 | 8/2001 | Silverbrook | 347/54 |
| 6,280,019 | B1 | 8/2001 | Giere et al. | 347/62 |
| 6,309,052 | B1 | 10/2001 | Prasad et al. | 347/57 |
| 6,561,627 | B1 | 5/2003 | Jarrold et al. | 347/54 |
| 6,598,960 | B1 * | 7/2003 | Cabal et al. | 347/56 |
| 6,644,786 | B1 * | 11/2003 | Lebens | 347/54 |
| 2001/0008406 | A1 | 7/2001 | Silverbrook | |

FOREIGN PATENT DOCUMENTS

| | | |
|---|---|---|
| JP | 2030543 | 1/1990 |

* cited by examiner

*Primary Examiner*—Juanita D. Stephens
(74) *Attorney, Agent, or Firm*—William R. Zimmerli

(57) ABSTRACT

An apparatus for a liquid drop emitter, especially for use in an ink jet printhead, is disclosed. A chamber filled with a liquid, a nozzle and a thermo-mechanical actuator, extending into the chamber from at least one wall of the chamber is disclosed. A movable element of the thermo-mechanical actuator is configured with a bending portion which bends when heated. The bending portion comprises a first layer having first and second sides, constructed of a first material having a high coefficient of thermal expansion, a second layer, attached to the second side of the first layer, and a third layer, attached to the first side of the first layer, constructed of a third material having a low thermal conductivity and a low Young's modulus. Apparatus is adapted to apply heat pulses to the bending portion resulting in rapid deflection of the movable element, ejection of a liquid drop, without degradation or vaporization of the liquid. The third material may be an organic polymer having a Young's modulus less than 10 GPa and thermal conductivity less than 1 W/(m ° K), for example PTFE, teflon.

39 Claims, 18 Drawing Sheets

LIQUID DROP EMITTER WITH REDUCED SURFACE TEMPERATURE ACTUATOR

FIELD OF THE INVENTION

The present invention relates generally to micro-electro-mechanical devices and, more particularly, to thermally actuated liquid drop emitters such as the type used for ink jet printing.

BACKGROUND OF THE INVENTION

Micro-electro mechanical systems (MEMS) are a relatively recent development. Such MEMS are being used as alternatives to conventional electro-mechanical devices as actuators, valves, and positioners. Micro-electromechanical devices are potentially low cost, due to use of microelectronic fabrication techniques. Novel applications are also being discovered due to the small size scale of MEMS devices.

Many potential applications of MEMS technology utilize thermal actuation to provide the motion needed in such devices. For example, many actuators, valves, and positioners use thermal actuators for movement. In some applications the movement required is pulsed. For example, rapid displacement from a first position to a second, followed by restoration of the actuator to the first position, might be used to generate pressure pulses in a fluid or to advance a mechanism one unit of distance or rotation per actuation pulse. Drop-on-demand liquid drop emitters use discrete pressure pulses to eject discrete amounts of liquid from a nozzle.

Drop-on-demand (DOD) liquid emission devices have been known as ink printing devices in ink jet printing systems for many years. Early devices were based on piezoelectric actuators such as are disclosed by Kyser et al., in U.S. Pat. No. 3,946,398 and Stemme in U.S. Pat. No. 3,747,120. A currently popular form of ink jet printing, thermal ink jet (or "bubble jet"), uses electroresistive heaters to generate vapor bubbles which cause drop emission, as is discussed by Hara et al., in U.S. Pat. No. 4,296,421.

Electroresistive heater actuators have manufacturing cost advantages over piezoelectric actuators because they can be fabricated using well developed microelectronic processes. On the other hand, the thermal ink jet drop ejection mechanism requires the ink to have a vaporizable component, and locally raises ink temperatures well above the boiling point of this component. This temperature exposure places severe limits on the formulation of inks and other liquids that may be reliably emitted by thermal ink jet devices. Piezoelectrically actuated devices do not impose such severe limitations on the liquids that can be jetted because the liquid is mechanically pressurized.

The availability, cost, and technical performance improvements that have been realized by ink jet device suppliers have also engendered interest in the devices for other applications requiring micro-metering of liquids. These new applications include dispensing specialized chemicals for micro-analytic chemistry as disclosed by Pease et al., in U.S. Pat. No. 5,599,695; dispensing coating materials for electronic device manufacturing as disclosed by Naka et al., in U.S. Pat. No. 5,902,648; and for dispensing microdrops for medical inhalation therapy as disclosed by Psaros et al., in U.S. Pat. No. 5,771,882. Devices and methods capable of emitting, on demand, micron-sized drops of a broad range of liquids are needed for highest quality image printing, but also for emerging applications where liquid dispensing requires mono-dispersion of ultra small drops, accurate placement and timing, and minute increments.

A low cost approach to micro drop emission is needed which can be used with a broad range of liquid formulations. Apparatus and methods are needed which combines the advantages of microelectronic fabrication used for thermal ink jet with the liquid composition latitude available to piezo-electro-mechanical devices.

A DOD ink jet device which uses a thermo-mechanical actuator was disclosed by T. Kitahara in JP 2,030,543, filed Jul. 21, 1988. The actuator is configured as a bi-layer cantilever moveable within an ink jet chamber. The beam is heated by a resistor causing it to bend due to a mismatch in thermal expansion of the layers. The free end of the beam moves to pressurize the ink at the nozzle causing drop emission. Recently K. Silverbrook in U.S. Pat. Nos. 6,067,797; 6,087,638; 6,239,821 and 6,243,113 has made disclosures of a similar thermo-mechanical DOD ink jet configuration. Methods of manufacturing thermo-mechanical ink jet devices using microelectronic processes have been disclosed by K. Silverbrook in U.S. Pat. Nos. 6,180,427; 6,254,793 and 6,274,056.

Thermo-mechanically actuated drop emitters employing a moving cantilevered element are promising as low cost devices which can be mass produced using microelectronic materials and equipment and which allow operation with liquids that would be unreliable in a thermal ink jet device. An alternate configuration of the thermal actuator, an elongated beam anchored within the liquid chamber at two opposing walls, is a promising approach when high forces are required to eject liquids having high viscosities. However, the design and operation of bending thermal actuators and drop emitters requires careful attention to preventing locations of potentially excessive heat, especially at the surfaces of the bending element which may be adjacent to the working liquid.

The immediately adjacent working liquid, for example ink for ink jet printing, may be overheated to the point of causing boiling, component degradation, or excessive air dissolution, if surface temperatures are allowed to reach temperatures above 200° C. or so. The production of vapor bubbles in the working liquid immediately adjacent a resistive heater is purposefully employed in thermal ink jet devices to provide pressure pulses sufficient to eject ink drops. However, such vapor bubble formation is undesirable in a thermo-mechanically actuated drop emitter because it causes anomalous, erratic changes in drop emission timing, volume, and velocity. Also bubble formation may be accompanied by highly aggressive bubble collapse damage and a build-up of degraded components of the working liquid on the cantilevered element.

Configurations for movable element thermal actuators are needed which can be operated at high repetition frequencies and with maximum force of actuation, while avoiding surface locations of extreme temperatures that may degrade or vaporize the adjacent working liquid.

SUMMARY OF THE INVENTION

It is therefore an object of the present invention to provide a thermally actuated drop emitter using a moving element that can be operated without causing degradation or vaporization of components of the working liquid.

It is also an object of the present invention to provide a thermally actuated drop emitter using a moving cantilevered element extending from a wall of a liquid chamber that does not have locations which reach excessive temperatures.

In addition, it is also an object of the present invention to provide a thermally actuated drop emitter using a beam element extending from opposite anchor walls of a liquid chamber having a central fluid displacement portion that does not have locations which reach excessive temperatures.

The foregoing and numerous other features, objects and advantages of the present invention will become readily apparent upon a review of the detailed description, claims and drawings set forth herein. These features, objects and advantages are accomplished by constructing a liquid drop emitter comprising a chamber, formed in a substrate, filled with a liquid and having a nozzle for emitting drops of the liquid. A thermo-mechanical actuator, extending into the chamber from at least one wall of the chamber, and having a movable element, resides in a first position proximate to the nozzle. The movable element is configured with a bending portion which bends when heated, the bending portion comprising a first layer having first and second sides, constructed of a first material having a high coefficient of thermal expansion, a second layer, attached to the second side of the first layer, and a third layer, attached to the first side of the first layer, constructed of a third material having a low thermal conductivity and a low Young's modulus. Apparatus is adapted to apply heat pulses to the bending portion resulting in rapid deflection of the movable element to a second position and ejection of a drop without causing substantial degradation or vaporization of the liquid. The movable element may be configured as a cantilever extending from an anchor wall of the chamber. The moveable element may also be configured as a beam anchored at opposite first and second anchor walls. The first material may be electrically resistive, for example, titanium aluminide, and the apparatus adapted to apply heat pulses may include a resistor formed in the first layer. The third material may be a polymer material having a melting point higher than 250° C., for example, polytetrafluoroethylene.

Liquid drop emitters of the present inventions are particularly useful in ink jet printheads for ink jet printing.

BRIEF DESCRIPTION OF THE DRAWINGS

FIG. 7 shows for comparison purposes calculated plots of the displacement versus time after the application of a heat pulse for a thermal actuator with a third layer of low thermal conductivity material and a thermal actuator with a third layer of high thermal conductivity material to illustrate the benefits of the present inventions;

DETAILED DESCRIPTION OF THE INVENTION

The invention has been described in detail with particular reference to certain preferred embodiments thereof, but it will be understood that variations and modifications can be effected within the spirit and scope of the invention.

As described in detail herein below, the present invention provides apparatus for a drop-on-demand liquid emission device. The most familiar of such devices are used as printheads in ink jet printing systems. Many other applications are emerging which make use of devices similar to ink jet printheads, however which emit liquids other than inks that need to be finely metered and deposited with high spatial precision. The terms ink jet and liquid drop emitter will be used herein interchangeably. The inventions described below provide drop emitters based on thermo-mechanical actuators that are configured so as allow the actuator to be operated at high temperatures without subjecting the working liquid to temperatures which would degrade or vaporize components of the liquid.

Figure 1:
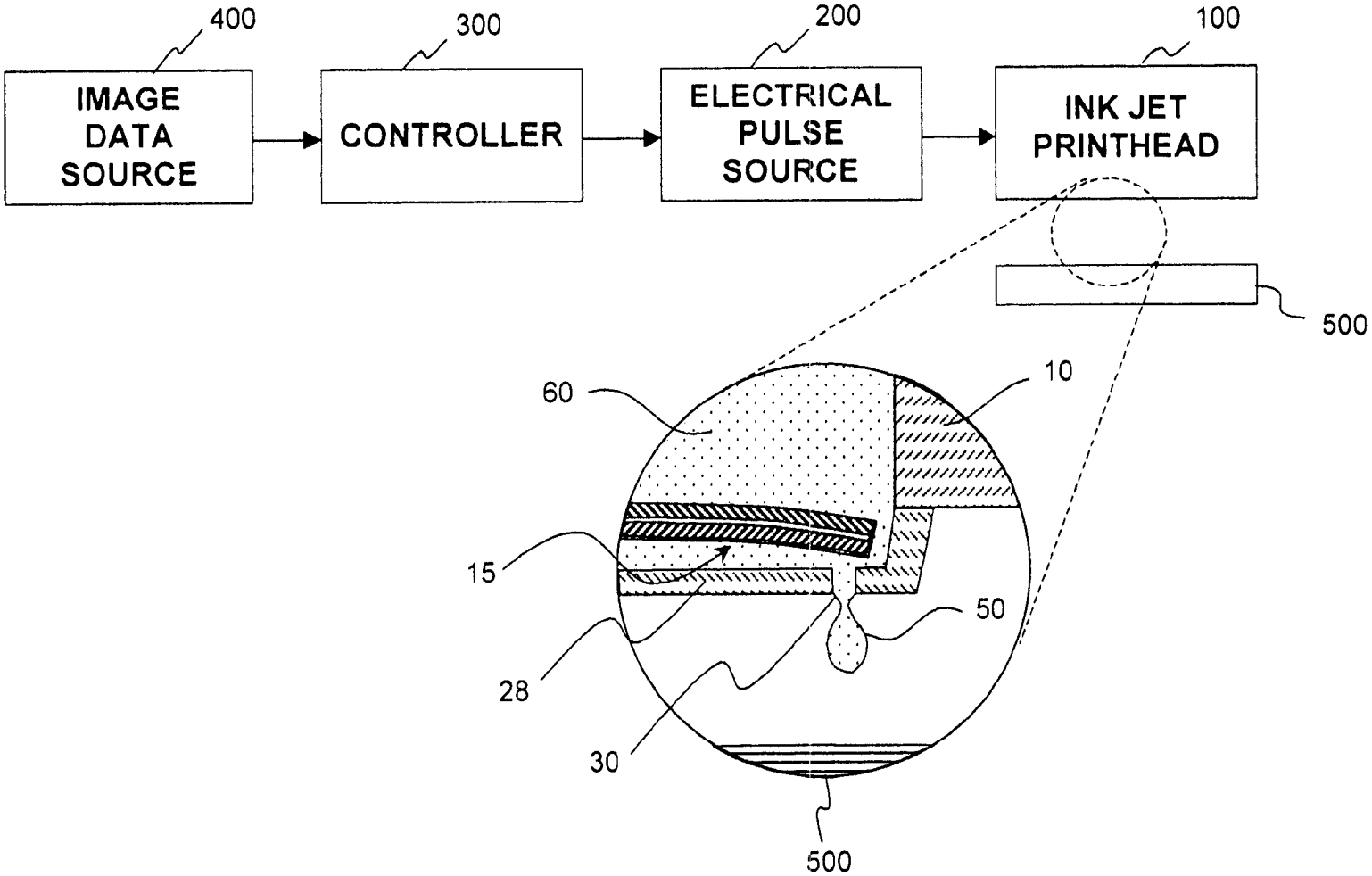
FIG. 1 is a schematic illustration of an ink jet system according to the present invention.

Turning first to FIG. 1, there is shown a schematic representation of an ink jet printing system which may use an apparatus and be operated according to the present invention. The system includes an image data source 400 that provides signals that are received by controller 300 as commands to print drops. Controller 300 outputs signals to a source of electrical pulses 200. Pulse source 200, in turn, generates an electrical voltage signal composed of electrical energy pulses which are applied to electrically resistive means associated with each thermo-mechanical actuator 15 within ink jet printhead 100. The electrical energy pulses cause a thermo-mechanical actuator 15 (herein after "thermal actuator") to rapidly bend, pressurizing ink 60 located at nozzle 30, and emitting an ink drop 50 which lands on receiver 500.

Figure 2:
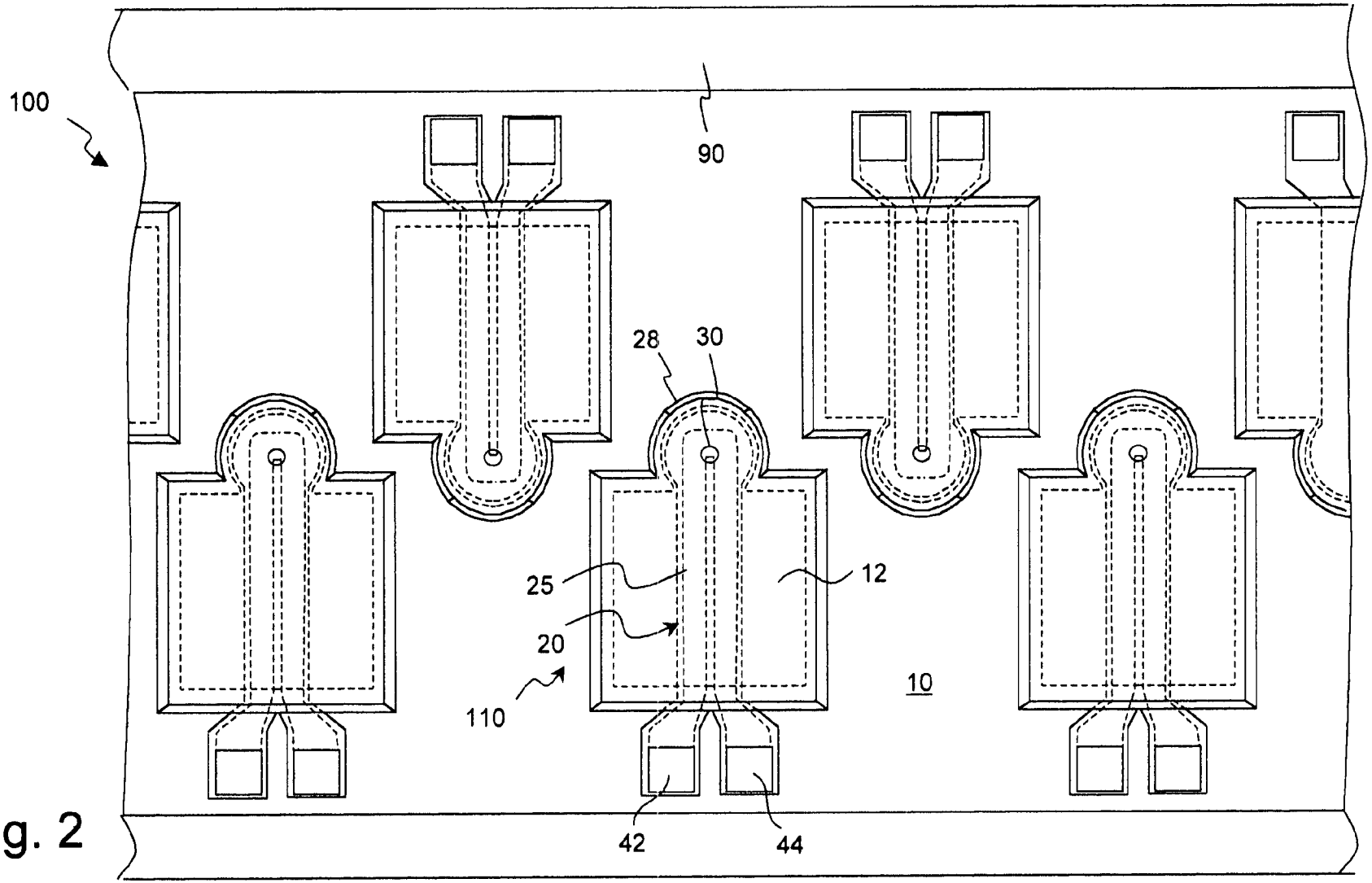
FIG. 2 is a plan view of a portion of an array of ink jet drop emitters.

FIG. 2 shows a plan view of a portion of ink jet printhead 100. An array of thermally actuated ink jet units 110 is shown having nozzles 30 centrally aligned, and ink chambers 12, interdigitated in two rows. The ink jet units 110 are formed on and in a substrate 10 using microelectronic fabrication methods. An example fabrication sequence which may be used to form drop emitters 110 is described in U.S. Pat. No. 6,561,627 for "Thermal Actuator," assigned to the assignee of the present invention.

Each drop emitter unit 110 has associated electrical lead contacts 42, 44 that are formed with, or are electrically connected to, a heater resistor portion 25, shown in phantom view in FIG. 2. In the illustrated embodiment, the heater resistor portion 25 is formed in a first layer of the thermal actuator 15 and participates in the thermo-mechanical effects as will be described. Element 90 of the printhead 100 is a mounting structure which provides a mounting surface for microelectronic substrate 10 and other means for interconnecting the liquid supply, electrical signals, and mechanical interface features.

Figure 3A:
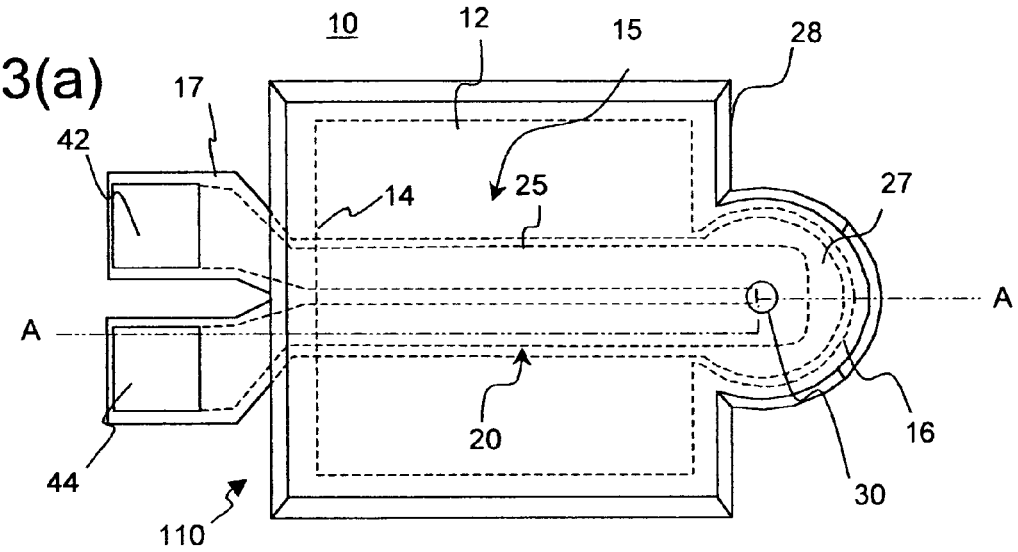
FIGS. 3(*a*) and (*b*) are enlarged plan views of an individual ink jet or liquid drop emitter unit according to the present invention.
Figure 3B:
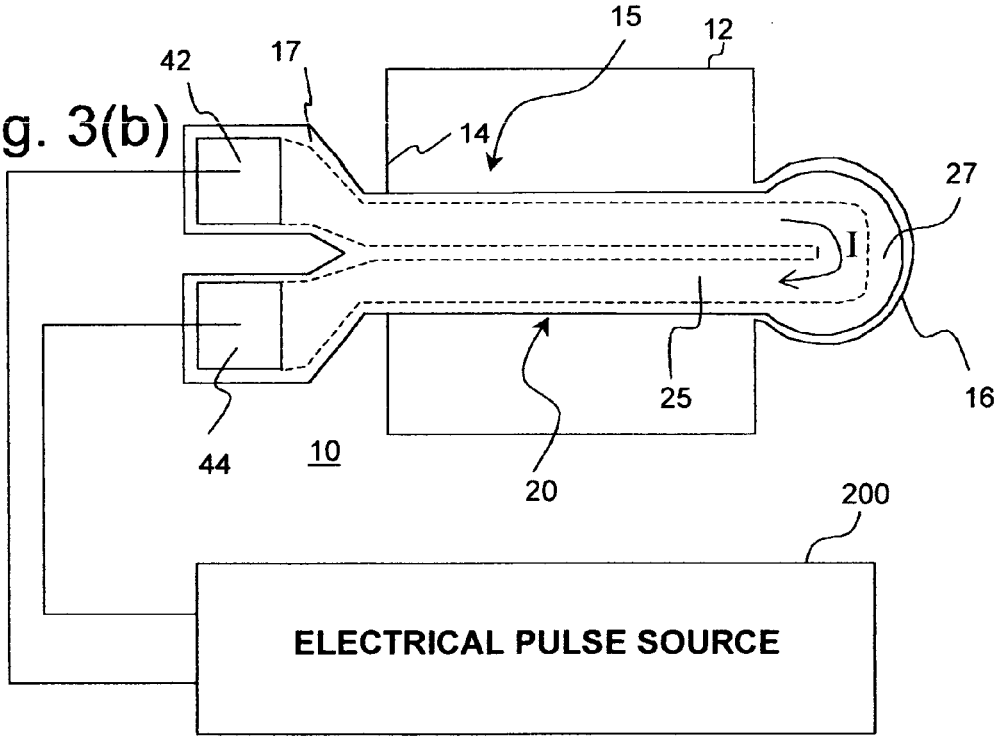

FIG. 3(*a*) illustrates a plan view of a single drop emitter unit 110 and a second plan view FIG. 3(*b*) with the liquid chamber cover 28, including nozzle 30, removed.

The thermal actuator 15, shown in phantom in FIG. 3(*a*) can be seen with solid lines in FIG. 3(*b*). The cantilevered element 20 of thermal actuator 15 extends from edge 14 of lower liquid chamber 12 which is formed in substrate 10. Cantilevered element anchor portion 17 is bonded to substrate 10 and anchors the cantilever.

The cantilevered element 20 of the actuator has the shape of a paddle, an extended flat shaft ending with a disc of larger diameter than the shaft width. This shape is merely illustrative of cantilever actuators that can be used, many other shapes are applicable. The paddle shape aligns the nozzle 30 with the center of the cantilevered element free end portion 27. The lower fluid chamber 12 has a curved wall portion at 16 which conforms to the curvature of the free end portion 27, spaced away to provide clearance for the actuator movement.

FIG. 3(*b*) illustrates schematically the attachment of electrical pulse source 200 to the resistive heater 25 at interconnect terminals 42 and 44. Voltage differences are applied to voltage terminals 42 and 44 to cause resistance heating via unshaped resistor 25. This is generally indicated by an arrow showing a current I. In the plan views of FIG. 3, the actuator free end portion 27 moves toward the viewer when pulsed and drops are emitted toward the viewer from the nozzle 30 in cover 28. This geometry of actuation and drop emission is called a "roof shooter" in many ink jet disclosures.

Figure 4A:
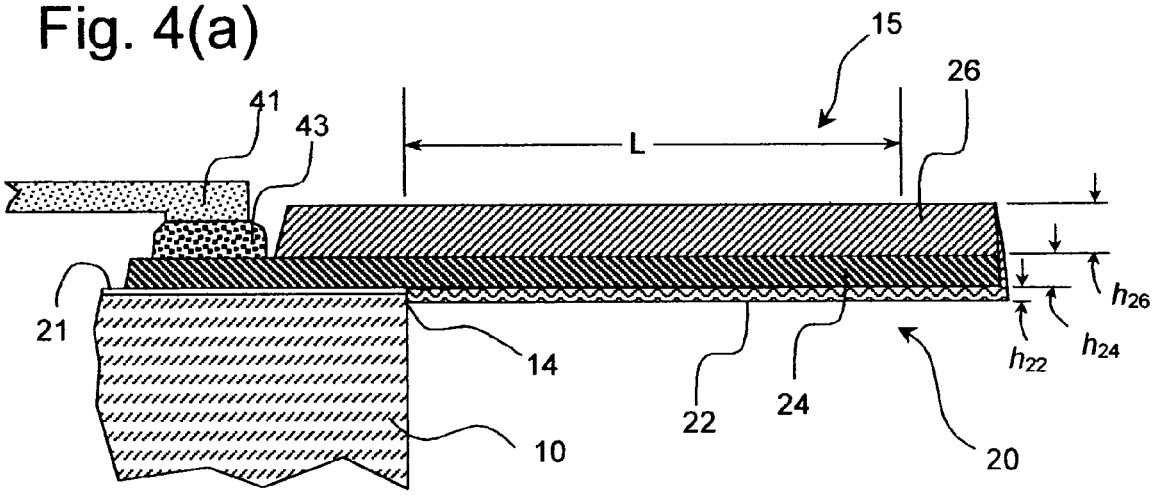
FIGS. 4(*a*) and 4(*b*) are side views formed along the line A—A in FIG. 3(*a*) illustrating first and second positions of the free end of a cantilevered element thermo-mechanical actuator according to the present invention.
Figure 4B:
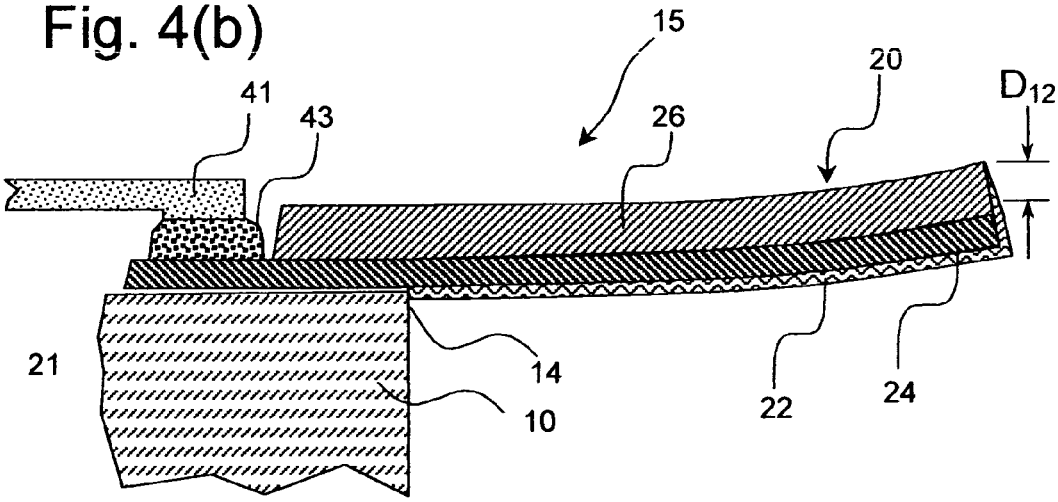

FIGS. 4(*a*) and 4(*b*) illustrate in side view a cantilevered thermal actuator 15 according to a preferred embodiment of the present invention. In FIG. 4(*a*) the actuator is in a first position and in FIG. 4(*b*) it is shown deflected upward to a second position. Cantilevered element 20 extends a length L from an anchor location 14 of base element 10 to the center of free end 27. The cantilevered element 20 is constructed of several layers. First layer 24 causes the upward deflection when it is thermally elongated with respect to other layers in the cantilevered element 20. It is constructed of an electrically resistive material, preferably intermetallic titanium aluminide, which has a large coefficient of thermal expansion. First layer 24 has a thickness of $h_{24}$.

The cantilevered element 20 also includes a second layer 26, attached to the first layer 24. The second layer 26 is constructed of a material having a low coefficient of thermal expansion, with respect to the material used to construct the first layer 24. The thickness of second layer 26 is chosen to provide the desired mechanical stiffness and to maximize the deflection of the cantilevered element for a given input of heat energy. Second layer 26 may also be a dielectric insulator to provide electrical insulation for resistive heater segments and current coupling devices and segments formed into the first layer or in a third material used in some preferred embodiments of the present inventions. The second layer may be used to partially define resistor and current coupler segments formed as portions of first layer 24. Second layer 26 has a thickness of $h_{26}$.

Second layer 26 may be composed of sub-layers, laminations of more than one material, so as to allow optimization of functions of heat flow management, electrical isolation, and strong bonding of the layers of the cantilevered element 20.

Passivation layer 21 shown in FIGS. 4(*a*) and 4(*b*) is provided to protect the first layer 24 chemically and electrically. Such protection may not be needed for some applications of thermal actuators according to the present invention, in which case it may be deleted. Liquid drop emitters utilizing thermal actuators which are touched on one or more surfaces by the working liquid may require passivation layer 21 which is chemically and electrically inert to the working liquid. Passivation layer 21 may also assist in the adhesion of third layer 22.

Third layer 22 is constructed of a third material having a low thermal conductivity and a low value of the Young's modulus. Third layer 22 is positioned between first layer 24 and the working liquid. As will be explained herein below, third layer 22 is added to the thermo-mechanical actuator to lower the peak temperature experienced by the working liquid in contact with the actuator. To operate the device, heat is applied directly to the first layer so that this layer becomes the hottest region of the thermal actuator. If third layer 22 is not employed, the surface adjacent to the first layer may become hot enough to degrade or vaporize the working liquid. Third layer 22 delays heat transfer to the working liquid long enough so that heat can dissipate into second layer 26 or out of the actuator via anchor portion 17, thereby reducing the peak temperature applied to the working liquid at the surface of the thermal actuator. A low Young's modulus material is used so as not to overly reduce the thermo-mechanical force generated by first and second layers 24 and 26.

A heat pulse is applied, via TAB lead 41 connoted to solder bump 43, to first layer 24, causing it to rise in temperature and elongate. Second layer 26 does not elongate nearly as much because of its smaller coefficient of thermal expansion and the time required for heat to diffuse from first layer 24 into second layer 26. The difference in length between first layer 24 and the second layer 26 causes the cantilevered element 20 to bend upward as illustrated in FIG. 4(*b*). The amount of deflection of the tip end from a first quiescent position to a second deflected position is noted as $D_{12}$. When used as actuators in drop emitters, the bending response of the cantilevered element 20 must be rapid enough to sufficiently pressurize the liquid at the nozzle. Typically, electroresistive heating apparatus is adapted to apply heat pulses and an electrical pulse duration of less than 4 $\mu$secs is used and, preferably, a duration less than 2 $\mu$secs.

For the purposes of the description of the present inventions herein, the cantilevered element will be said to be quiescent or in its first position when the free end is not significantly changing in deflected position. For ease of understanding, the first position is depicted as horizontal in FIG. 4(*a*). However, operation of thermal actuators about a bent first position are known and anticipated by the inventors of the present invention and are fully within the scope of the present inventions.

FIGS. 5 through 10(*b*) illustrate fabrication processing steps for constructing a single liquid drop emitter according to some of the preferred embodiments of the present invention. For these embodiments the first layer 24 is constructed using an electrically resistive material, such as titanium aluminide, and a portion is patterned into a resistor for carrying electrical current, I.

Figure 5:
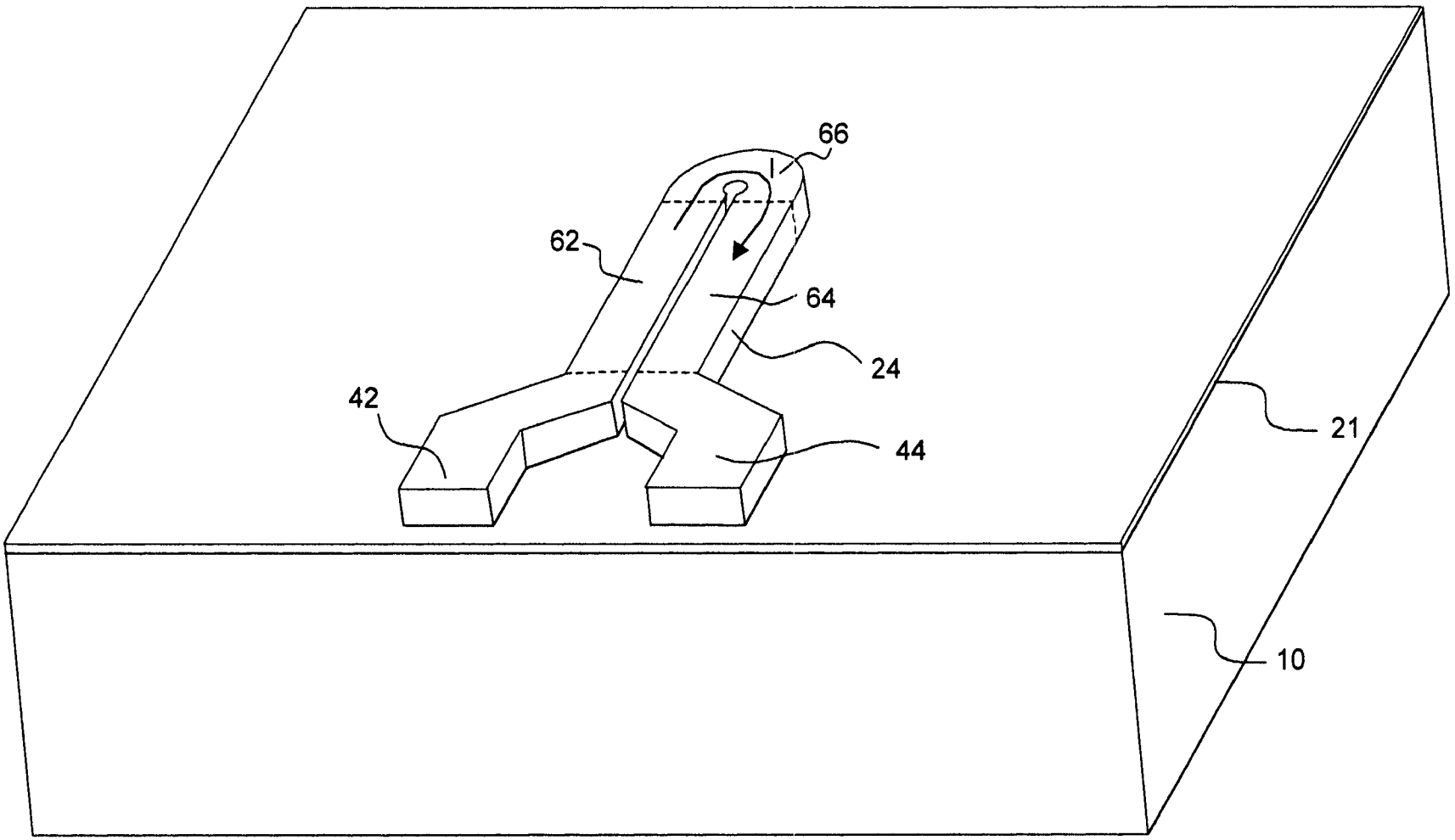
FIG. 5 is a perspective view of an initial process stage for constructing some preferred embodiments of a thermo-mechanical actuator according to the present invention wherein a first layer of an electrically resistive first material of the cantilevered element is formed over a passivation layer on a substrate.

FIG. 5 illustrates a first layer 24 of a cantilevered element in a first stage of fabrication. The illustrated structure is formed on a substrate 10, for example, single crystal silicon, by standard microelectronic deposition and patterning methods. A portion of substrate 10 will also serve as a base element from which cantilevered element 20 extends. Deposition of preferred first material intermetallic titanium aluminide may be carried out, for example, by RF or pulsed DC magnetron sputtering. An example deposition process that may be used for titanium aluminide is described in U.S. Pat. No. 6,561,627 for "Thermal Actuator," assigned to the assignee of the present invention.

First layer 24 is deposited with a thickness of $h_{24}$. First and second resistor segments 62 and 64 are formed in first layer 24 by removing a pattern of the electrically resistive material. In addition, a current coupling segment 66 is formed in the first material which conducts current serially between the first resistor segment 62 and the second resistor segment 64. An arrow and letter "I" indicate the current path. Current coupling segment 66, formed in the electrically resistive material, will also heat the cantilevered element when conducting current. However this coupler heat energy, being introduced at the tip end of the cantilever, is not important or necessary to the deflection of the thermal actuator. The primary function of coupler segment 66 is to reverse the direction of current.

Addressing electrical leads 42 and 44 are illustrated as being formed in the first layer 24 material as well. Leads 42, 44 may make contact with circuitry previously formed in base element substrate 10 or may be contacted externally by other standard electrical interconnection methods, such as tape automated bonding (TAB) or wire bonding. A passivation layer 21 may be formed on substrate 10 before the deposition and patterning of the first layer 24 material. This passivation layer may be left under first layer 24 and other subsequent structures or removed in a subsequent patterning process.

Figure 6:
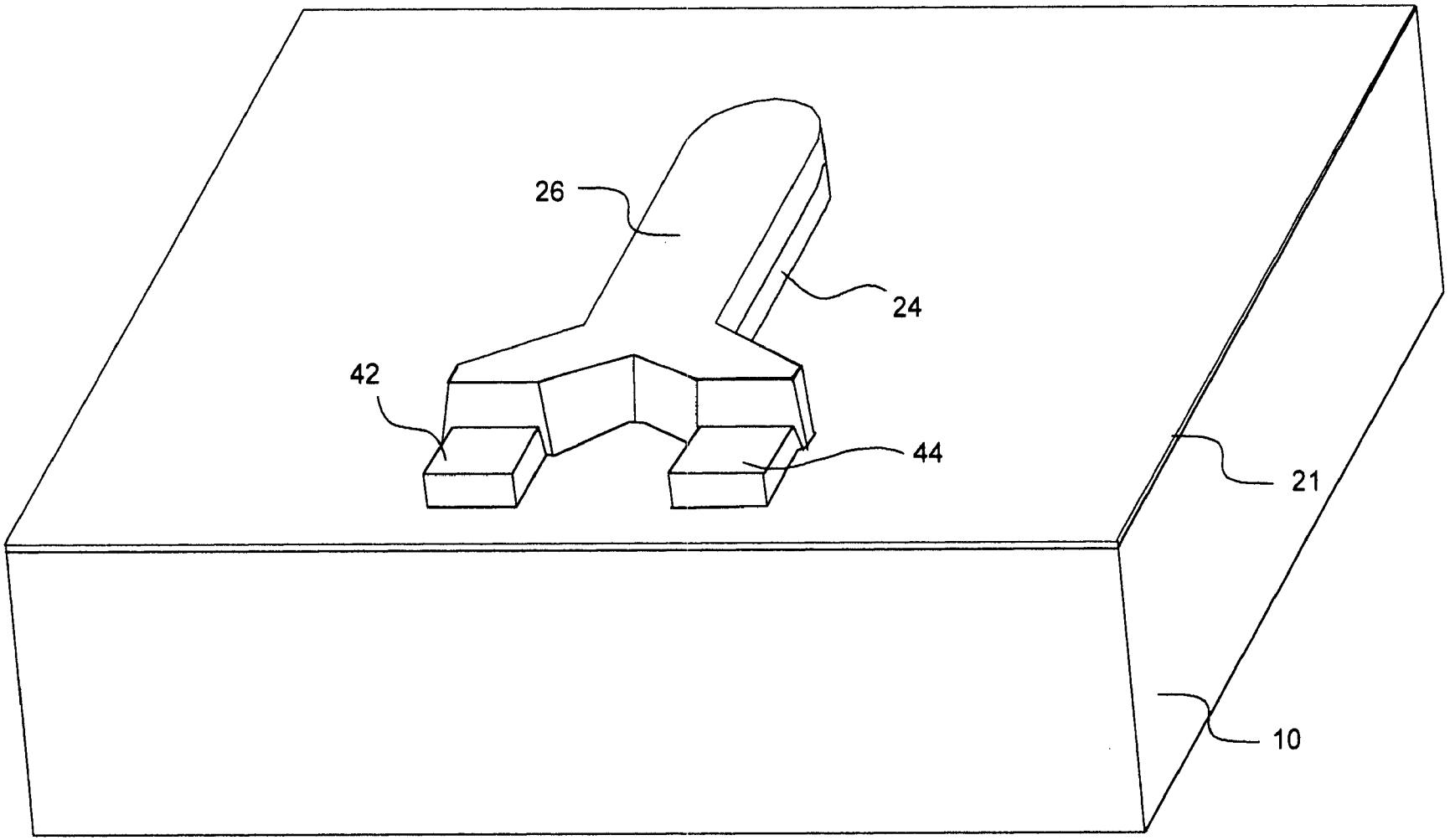
FIG. 6 is a perspective view of a next process stage for some preferred configurations the present invention wherein a second layer of a low thermal expansion material is formed.

FIG. 6 illustrates a second layer 26 having been deposited and patterned over the previously formed first layer 24 portion of the thermal actuator. Second layer 26 is formed over the first layer 24 covering the remaining resistor pattern. Second layer 26 is deposited with a thickness of $h_{26}$. The second layer 26 material has low coefficient of thermal expansion compared to the material of first layer 24. For example, second layer 26 may be silicon dioxide, silicon nitride, silicon carbide, aluminum oxide or some multi-layered lamination of these materials or the like.

Additional passivation materials may be applied at this stage over the second layer 26 for chemical and electrical protection. Also, the initial passivation layer 21 is patterned away from areas through which fluid will pass from openings to be etched in substrate 10.

Figure 7:
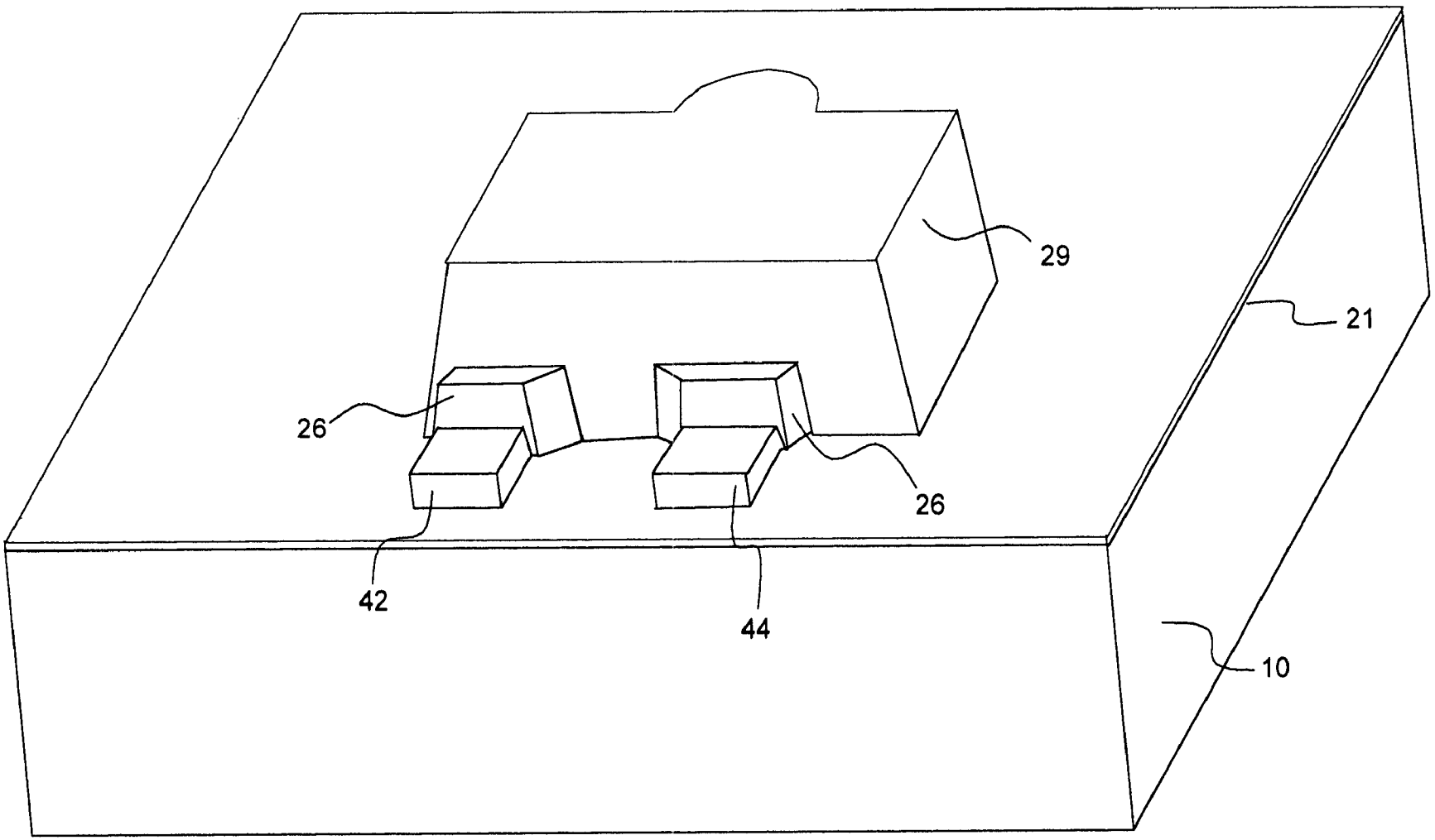
FIG. 7 is a perspective view of the next stages of the process illustrated in FIGS. 5 and 6 wherein a sacrificial layer in the shape of the liquid filling an upper chamber of a liquid drop emitter according to the present invention is formed.

FIG. 7 shows the addition of a sacrificial layer 29 which is formed into the shape of the interior of a chamber of a liquid drop emitter. A suitable material for this purpose is polyimide. Polyimide is applied to the device substrate in sufficient depth to also planarize the surface that has the topography of the first 24 and second 26 layers as illustrated in FIGS. 5–7. Any material which can be selectively removed with respect to the adjacent materials may be used to construct sacrificial structure 29.

Figure 8:
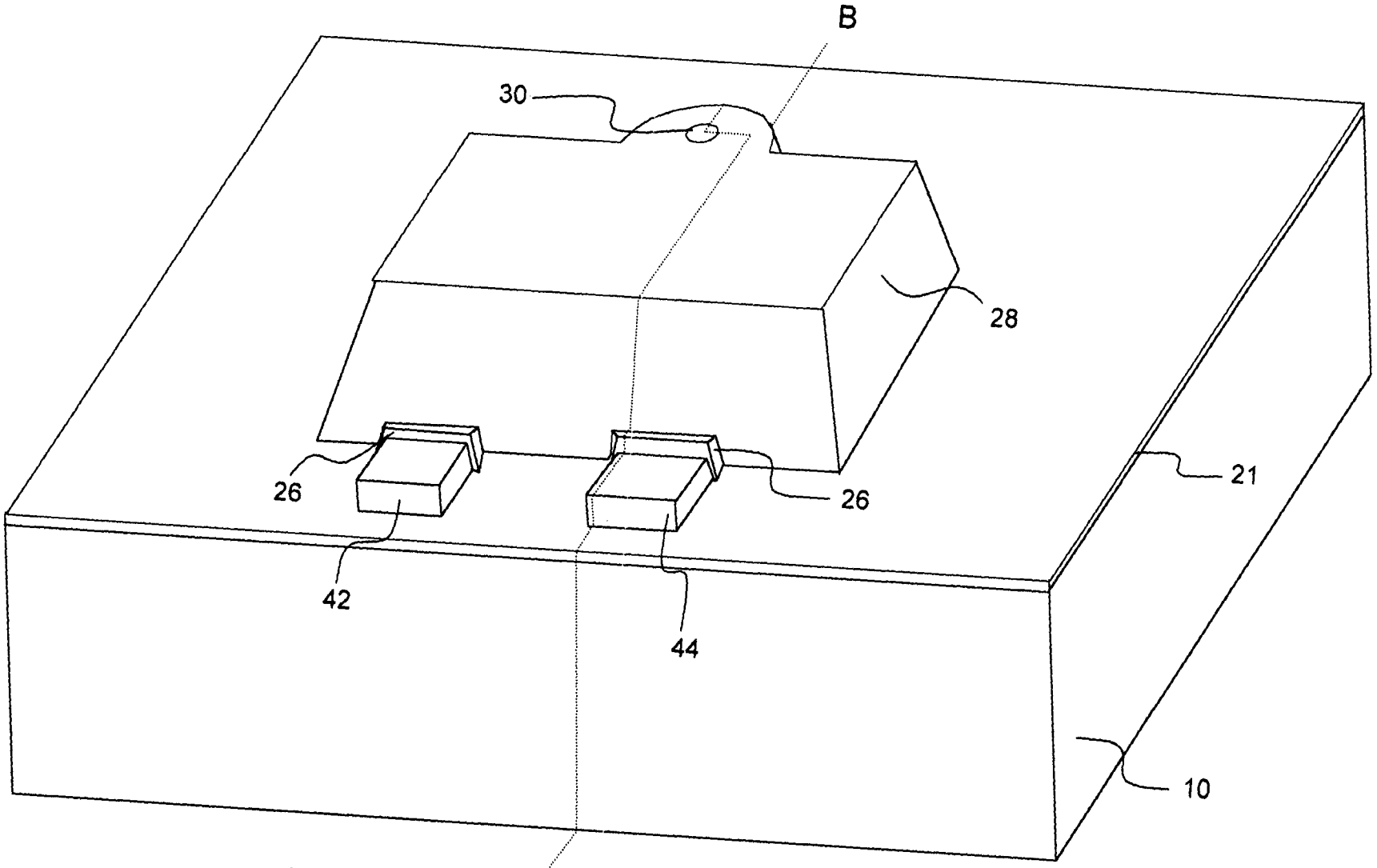
FIG. 8 is a perspective view of the next stages of the process illustrated in FIGS. 5–7 wherein an upper liquid chamber and nozzle of a drop emitter according to the present invention are formed.

FIG. 8 illustrates drop emitter liquid chamber walls and cover formed by depositing a conformal material, such as plasma deposited silicon oxide, nitride, or the like, over the sacrificial layer structure 29. This layer is patterned to form drop emitter chamber 28. Nozzle 30 is formed in the drop emitter chamber, communicating to the sacrificial material layer 29, which remains within the drop emitter chamber 28 at this stage of the fabrication sequence.

Figure 9A:
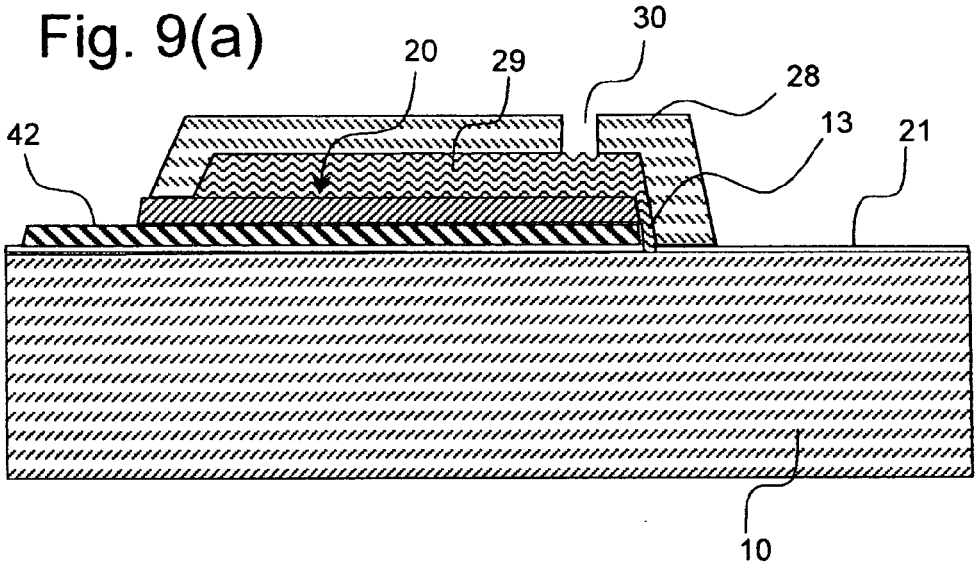
FIGS. 9(*a*)–9(*c*) are side views along line B—B of FIG. 8 of final stages of the process illustrated in FIGS. 5–8 wherein a liquid supply pathway is formed and the sacrificial layer is removed releasing the cantilevered element for movement.
Figure 9B:
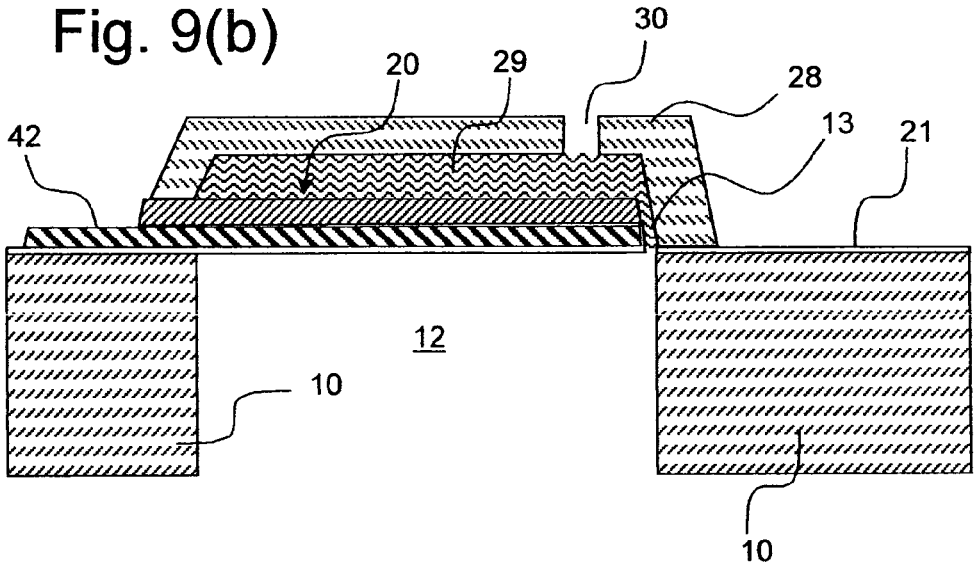
Figure 9C:
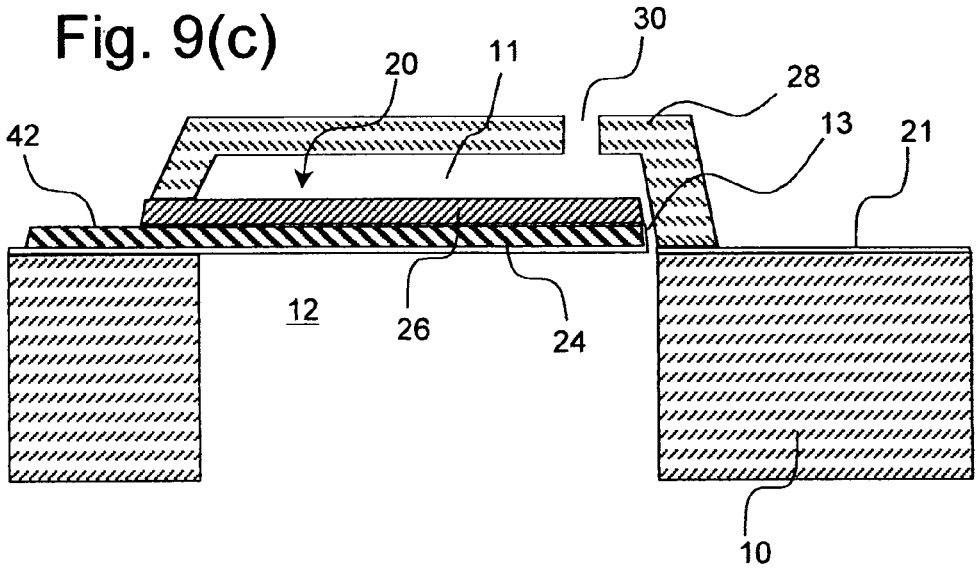

FIGS. 9(*a*)–9(*c*) show side views of the device through a section indicated as B—B in FIG. 8. In FIG. 9(*a*) the sacrificial layer 29 is enclosed within the drop emitter chamber walls 28 except for nozzle opening 30. Also illustrated in FIG. 9(*a*), the substrate 10 is intact. Passivation layer 21 has been removed from the surface of substrate 10 in gap area 13 and around the periphery of the cantilevered element 20. The removal of layer 21 in these locations was done at a fabrication stage before the forming of sacrificial structure 29.

In FIG. 9(*b*), substrate 10 is removed beneath the cantilever element 20 and the liquid chamber areas around and beside the cantilever element 20. The removal may be done by an anisotropic etching process such as reactive ion etching, or such as orientation dependent etching for the case where the substrate used is single crystal silicon. For constructing a thermal actuator alone, the sacrificial structure and liquid chamber steps are not needed and this step of etching away substrate 10 may be used to release the cantilevered element 20.

In FIG. 9(*c*) the sacrificial material layer 29 has been removed by dry etching using oxygen and fluorine sources. The etchant gasses enter via the nozzle 30 and from the newly opened fluid supply chamber area 12, etched previously from the backside of substrate 10. This step releases the cantilevered element 20.

Figure 10A:
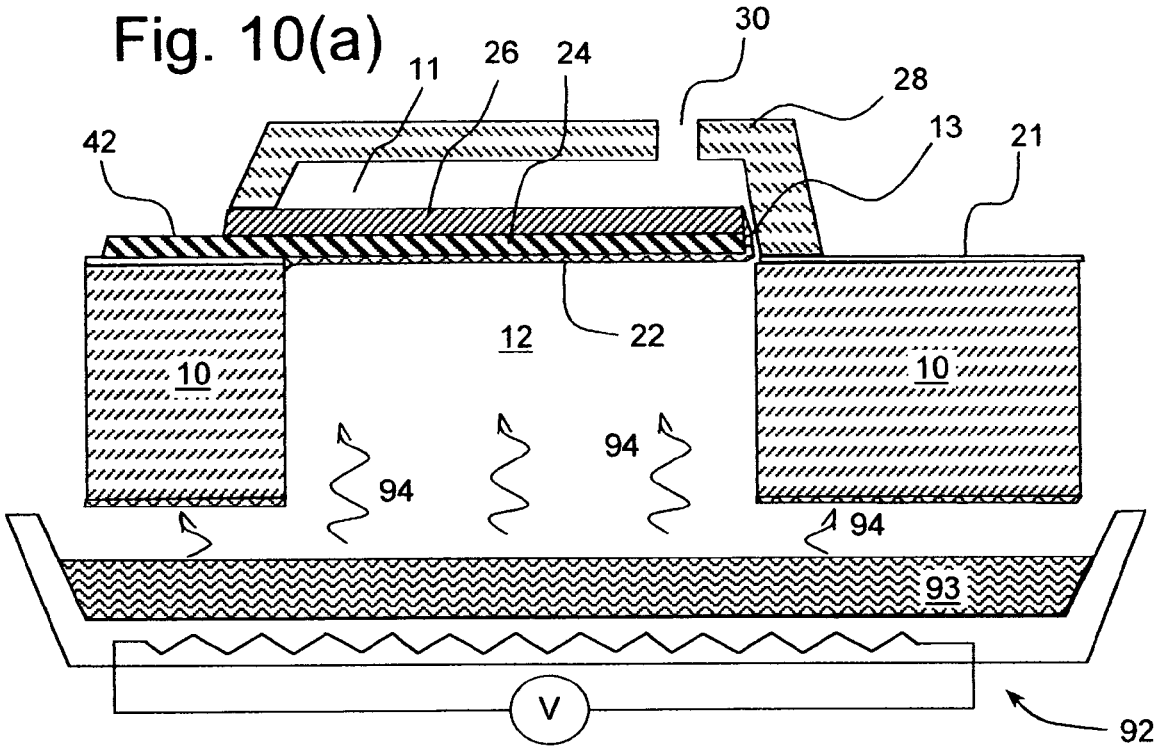
FIGS. 10(*a*) and 10(*b*) are side views along line B—B of FIG. 8 illustrating two alternate fabrication methods for adding a third layer to the thermo-mechanical element, completing the drop emitter according to the present inventions.
Figure 10B:
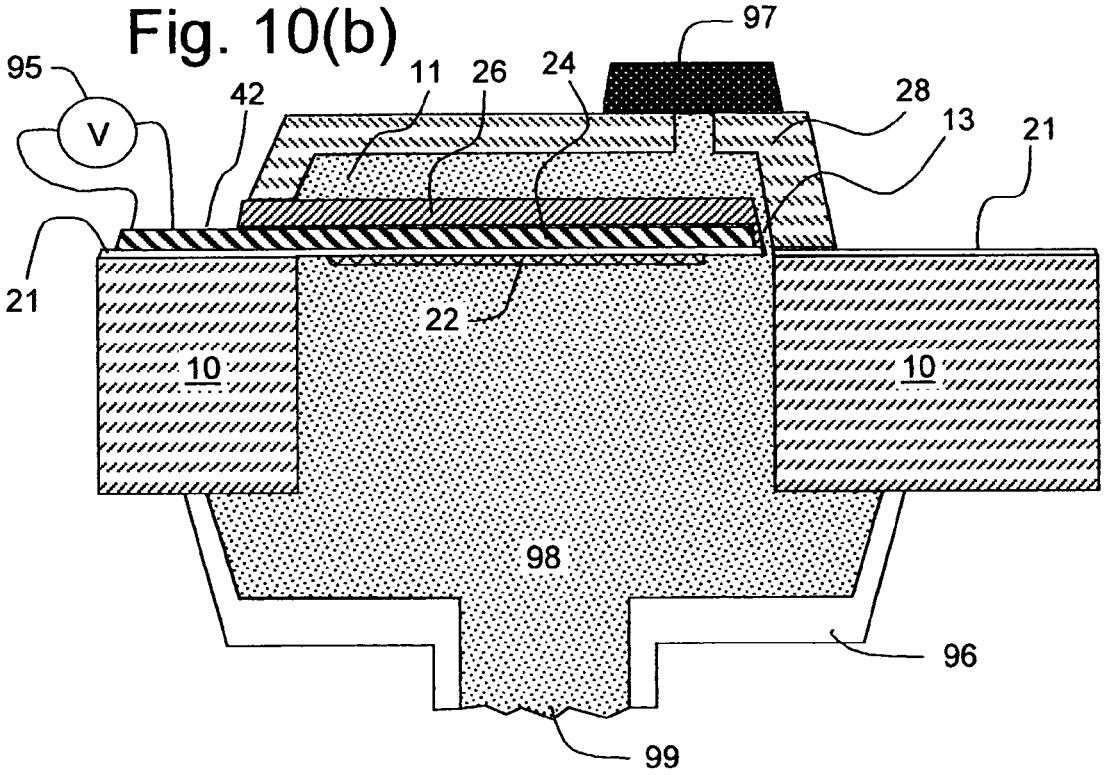

FIGS. 10(*a*) and 10(*b*) illustrate fabrication processes for the addition of third layer 22. Material deposition by thermal evaporation is illustrated in FIG. 10(*a*). A thermal evaporator apparatus 92 is schematically illustrated positioned beneath the drop emitter unit so that material may be evaporated up through the lower chamber 12 and impinge on the first layer 24 of the cantilevered element. Third layer material 93 is converted into a vapor 94 which travels in a line-of-sight fashion above the evaporator, coating any surfaces it can reach. This process has been used by the inventors of the present inventions to coat teflon onto the underneath side of a cantilevered element thermal actuator as illustrated. Various masking techniques may be employed to prevent third material from coating in unwanted places or lift-off techniques may be used to subsequently remove third material.

FIG. 10(*b*) illustrates an insitu coating process in which the heater resistor formed in first layer 24 is used to direct the deposition of a third material to surfaces immediately adjacent. For example the third material might be in solution or a colloidal dispersion which deposits and adheres to areas pulsed to high temperatures or electrophoretically attracted to areas held at a high voltage. While such an insitu method might not fully coat all areas adjacent first layer 24, it is only necessary to sufficiently cost areas which reach high temperatures in order to provide the desired thermal barrier of the present inventions. FIG. 10(*b*) shows a supply manifold 96 having inlet 99 and which supplies a solution or dispersion 98 of a precursor material for third layer 22. A temporary plug 97 blocking nozzle 30 is illustrated, however precursor solution 98 might be pumped through the device and out nozzle opening 30 as well. A deposition process signal 95 is applied to the heater resistor portion of the first layer 24 via input electrodes 42 and 44 (not shown). The deposition process signal might be a floating voltage for electrophoretic deposition, a high current signal for heating, or some combination of these.

Other chemical deposition processes, such as the condensation of a chemical vapor onto the released thermal actuator might be used as well. There are alternate thermo-mechanical configurations wherein first layer 24 is fabricated "on top" of the multi-layer stack In this case, third layer 22 may be deposited and patterned over the thermo-mechanical element using sputtering processes, spin coating or the like, prior to the formation or attachment of an upper liquid chamber structure 28.

Figure 11A:
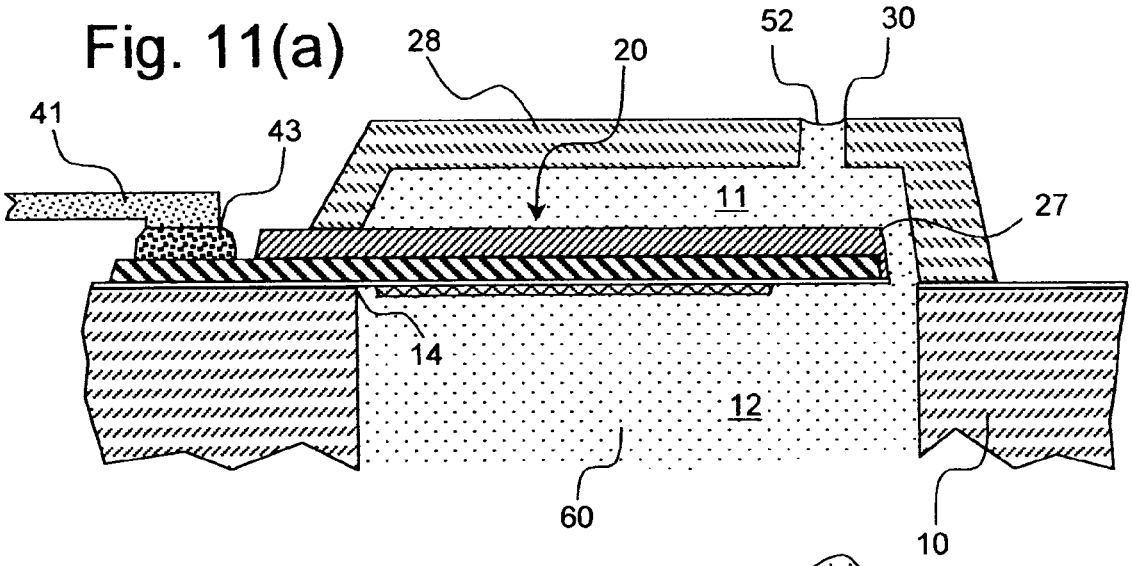
FIGS. 11(*a*) and 11(*b*) are side views side views along line B—B of FIG. 8 illustrating the cantilevered element in a first and second position causing the emission of a drop and FIG. 11(*c*) illustrates erratic behavior of a drop emitter which is not configured according to the present inventions.
Figure 11B:
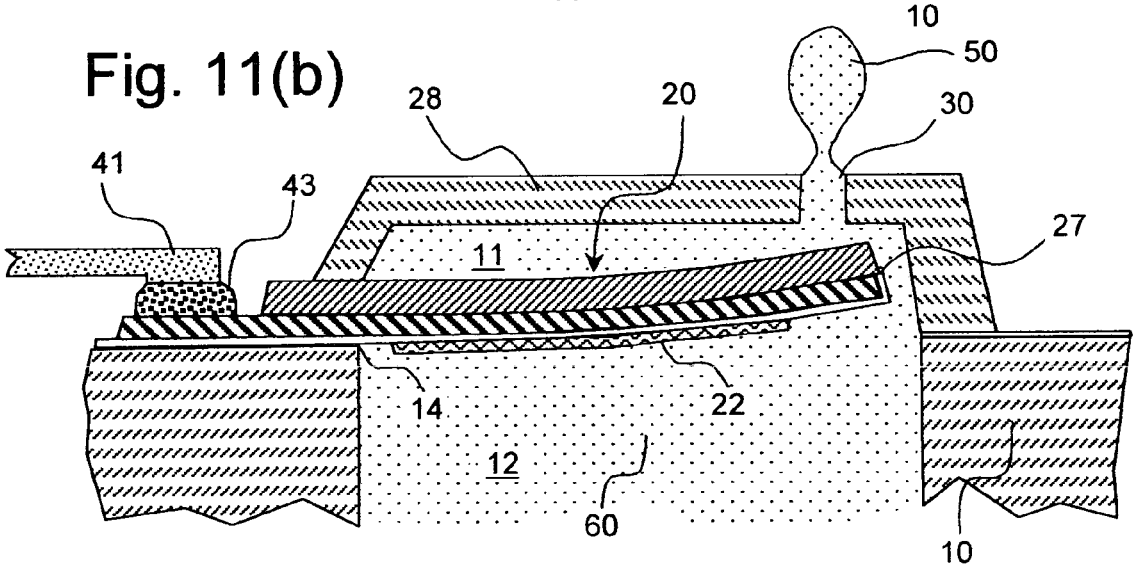
Figure 11C:
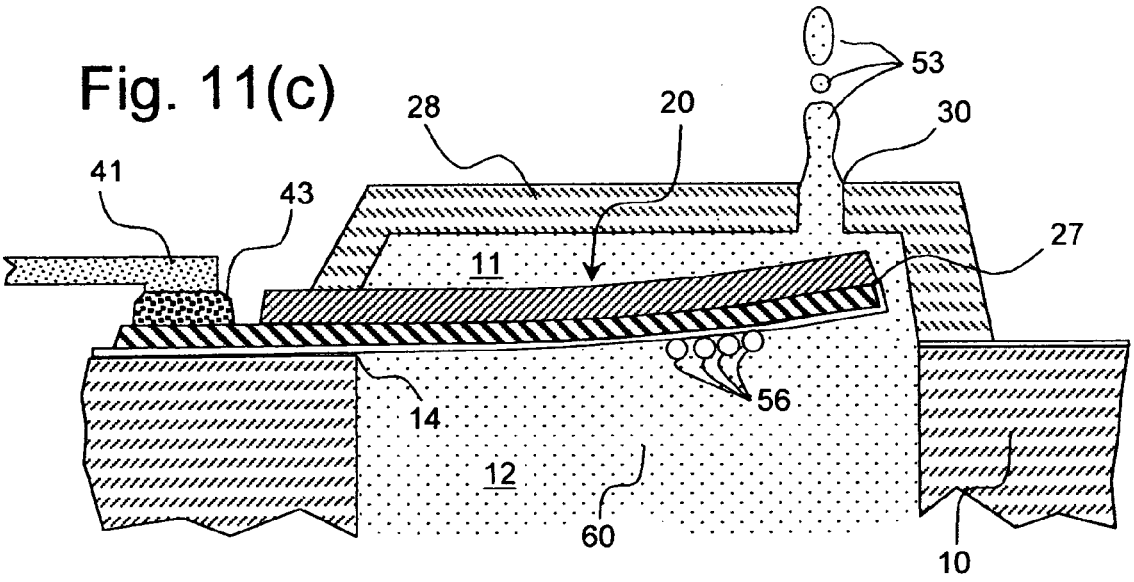

FIGS. 11(*a*) and 11(*b*) illustrate side views of a liquid drop emitter structure according to some preferred embodiments of the present invention. FIG. 11(*a*) shows the cantilevered element 20 in a first position proximate to nozzle 30. FIG. 11(*b*) illustrates the deflection of the free end 27 of the cantilevered element 20 towards nozzle 30. Rapid deflection of the cantilevered element to this second position pressurizes liquid 60 causing a drop 50 to be emitted.

In an operating emitter of the cantilevered element type illustrated, the quiescent first position may be a partially bent condition of the cantilevered element 20 rather than the horizontal condition illustrated FIG. 11(*a*). The actuator may be bent upward or downward at room temperature because of internal stresses that remain after one or more microelectronic deposition or curing processes. The device may be operated at an elevated temperature for various purposes, including thermal management design and ink property control. If so, the first position may be as substantially bent as is illustrated in FIG. 11(*b*).

For the purposes of the description of the present invention herein, the cantilevered element will be said to be quiescent or in its first position when the free end is not significantly changing in deflected position. For ease of understanding, the first position is depicted as horizontal in FIG. 4(*a*) and FIG. 11(*a*). However, operation of thermal actuators about a bent first position are known and anticipated by the inventor of the present invention and are fully within the scope of the present inventions.

FIG. 11(*c*) illustrates in side view a liquid drop emitter that is not according to the present inventions, for comparison purposes. The cantilevered element 20 does not have third layer 22. As a result, when a heat pulse is applied sufficient to cause drop emission, vapor bubbles 56 of the working liquid are generated, causing erratic drop emission 53 which consists of drops of unpredictable volume and number.

Figure 12A:
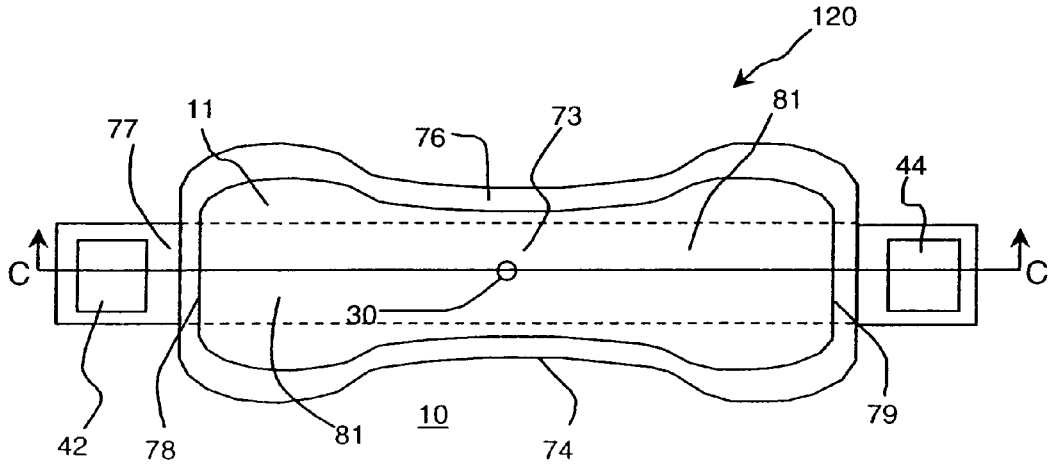
FIGS. 12(*a*) and 12(*b*) are enlarged plan views of an individual ink jet or liquid drop emitter unit based on a clamped beam element thermo-mechanical actuator according to the present invention.
Figure 12B:
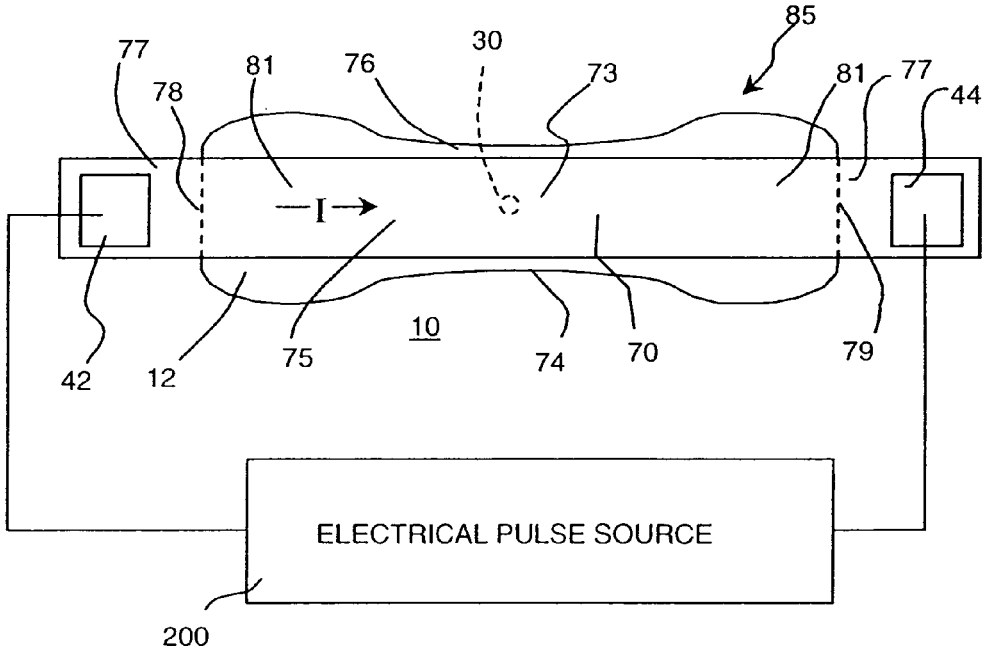

FIGS. 12(*a*) and 12(*b*) illustrate a plan view of a single drop emitter unit 120 with and without the liquid chamber cover 28, including nozzle 30, removed. Drop emitter unit 120 utilizes a thermo-mechanical actuator 85 configured as a beam element 70 having anchored portion 77 and extending from opposite first and second anchor walls 78, 79 of the chamber 12 and having a central fluid displacement portion 73 that resides in a first position proximate to the nozzle. The beam element has bending portions 81 adjacent the first and second anchor walls 78, 79 that bend when heated. The bending portions 81 are comprised in similar fashion to the cantilevered element discussed herein above of a first layer 24 constructed of a first material having a high coefficient of thermal expansion, a second layer 26 constructed of a material having a low coefficient of thermal expansion and third layer 22, constructed of a third material having a low thermal conductivity and a low Young's modulus.

The thermal actuator 85 is configured to operate in a snap-through mode. The beam element 70 of the actuator has the shape of a long, thin and wide beam. This shape is merely illustrative of beam elements that can be used. Many other shapes are applicable. For some embodiments of the present invention the deformable element may be a plate which is attached to the base element continuously around its perimeter.

In FIGS. 12(*a*) and (*b*) the fluid chamber 12 has a narrowed wall portion at 74 that conforms to the central fluid displacement portion 73 of beam element 70, spaced away to provide clearance 76 for the actuator movement during snap-through deformation. The close positioning of the walls of chamber 12, where the maximum deformation of the snap-through actuator occurs, helps to concentrate the pressure impulse generated to efficiently affect liquid drop emission at the nozzle 30.

FIG. 12(*b*) illustrates schematically the attachment of electrical pulse source 200 to the electrically resistive heater (coincident with first layer 24 of beam element 70) at heater electrodes 42 and 44. Voltage differences are applied to voltage terminals 42 and 44 to cause resistance heating via the resistor. This is generally indicated by an arrow showing a current I. In the plan views of FIGS. 12(*a*) and 12(*b*), the central fluid displacement portion 73 of beam element 70 moves toward the viewer when it is heated and forcefully snaps-through its central plane. Drops are emitted toward the viewer from the nozzle 30 in cover 28. This geometry of actuation and drop emission is called a "roof shooter" in many ink jet disclosures.

Figure 13A:
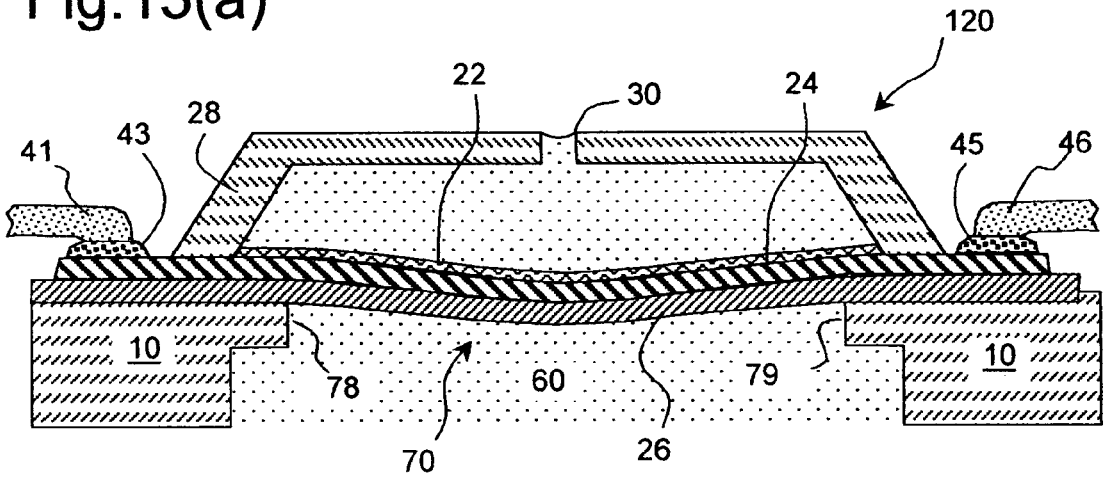
FIGS. 13(*a*) and 13(*b*) are side views formed along the line C—C in FIG. 12(*a*) illustrating first and second positions of the central fluid displacement portion of a beam element thermo-mechanical actuator according to the present invention.
Figure 13B:
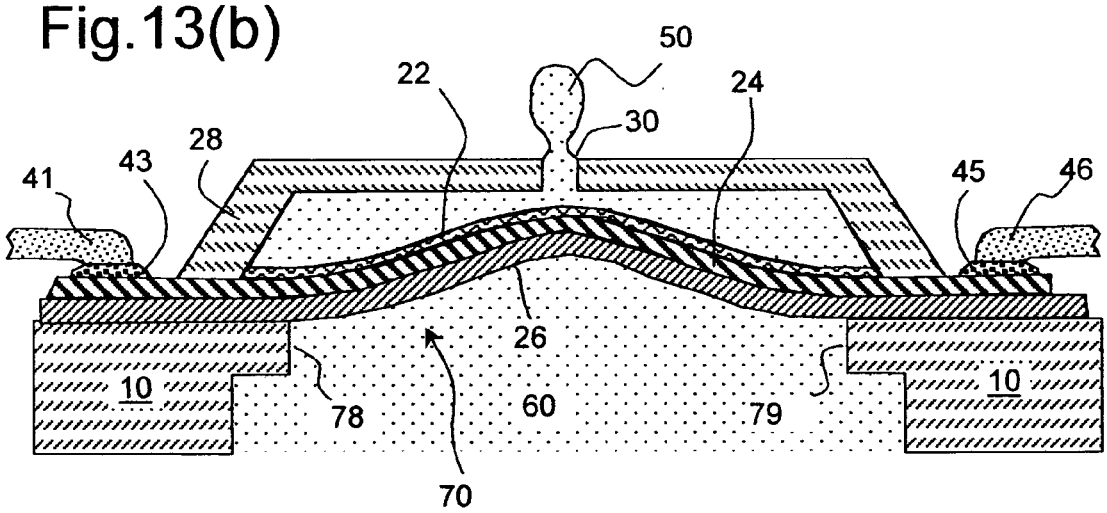

FIGS. 13(*a*) and 13(*b*) illustrate in side view a snap-through thermal actuator according to a preferred embodiment of the present invention. The side views in FIGS. 13(*a*) and (*b*) are formed along the line C—C in FIG. 12(*a*). In FIG. 13(*a*) the beam element 70 is in a first quiescent position having a residual shape bowed downward away from first layer 24. FIG. 13(*b*) shows the beam element buckled upward to a second position after undergoing snap-through transition through a central plane. Beam element 70 is anchored to substrate 10 which serves as a base element for the snap-through thermal actuator. Beam element 70 is attached to opposing anchor edges 78, 79 of substrate base element 10 using materials and a configuration that results in semi-rigid connections. In FIGS. 13(*a*) and 13(*b*), a portion of the base element 10 material has been removed immediately below opposing anchor edges 14 to render the structure at the attachment walls 78, 79 somewhat flexible, i.e. semi-rigid.

Beam element 70 is constructed of at least three layers. First layer 24 is constructed of a first material having a large coefficient of thermal expansion to cause an upward thermal moment and subsequent snap-through buckling when it is thermally elongated with respect to other layers in the deformable element. First layer 24 has a first side which is uppermost and a second side which is lowermost in FIGS. 13(*a*) and 13(*b*). Second layer 26 is attached to the second, lowermost, side of first layer 24 and is constructed of a material having a substantially smaller coefficient of thermal expansion than the material used to construct first layer 24. The thickness, Young's modulus, and coefficient of thermal expansion of at least first layer 24 and second layer 26 are selected to result in a thermal moment of substantial magnitude over a temperature range that is practical for the device materials and any working fluids involved. Third layer 22 is formed on the first, uppermost, side of first layer 24 in order to delay heat transfer to working liquid 60, thereby avoiding excessive heating of the working liquid and preventing degradation or vaporization.

Other layers may be included in the construction of beam element 70. Additional material layers, or sub-layers of first layer 24 and second layer 26, may be used for thermo-mechanical performance, electrical resistivity, dielectric insulation, chemical protection and passivation, adhesive strength, fabrication cost, light absorption and so on.

A heat pulse is applied to first layer 24, via solder bump 45 and TAB lead 46, causing it to rise in temperature and elongate. Initially the elongation causes the deformable element to buckle farther in the direction of the residual shape bowing (downward in FIG. 13(*a*)). Second layer 26 also rises in temperature and elongates due to some thermal expansion but also in response to the stress applied by first layer 24. Substantial elastic energy is stored in the elongated layers of the beam element. At a sufficiently high temperature, the thennal moment causes the beam element 70 to reverse in a rapid snap-through transition resulting in a deformation, a buckling upward in a direction opposite to the residual shape bowing. The rapid snap-through transition produces a pressure impulse in the liquid at the nozzle 30, causing a drop 50 to be ejected.

Third layer 22, constructed of a third material having a low thermal conductivity and low Young's modulus, delays the transmission of excessive heat to the working liquid during the time that heat is transferring from first layer 24 to the second layer 26 and while the forces which generate the snap-through effect are building within the beam element. A low Young's modulus third material is desirable so that third layer 22 does not resist the snap through effect and does not overly diminish the magnitude of deflection toward the nozzle that generates drop emission.

When used as actuators in drop emitters, the buckling response of the beam element 70 must be rapid enough to sufficiently pressurize the liquid at the nozzle. Typically, electrically resistive heating apparatus is adapted to apply heat pulses and an electrical pulse duration of less than 10 $\mu$secs is used and, preferably, a duration less than 2 $\mu$secs.

The beam element thermal actuators illustrated in FIGS. 12(*a*)–13(*b*) were constructed so that the first layer 24 is "away" from the substrate and the liquid refill pathway through substrate 10. For such configurations wherein the first layer is accessible from above the substrate, is not necessary to wait until the liquid feed through is formed in order to apply the third layer. For these thermal actuator configurations third layer 22 may be applied and patterned by any traditional coating method, including evaporation and insitu processing, at a fabrication step prior to the formation or attachment of the upper liquid chamber.

The foregoing analysis has been presented in terms of a bi-layer thermo-mechanical element which includes first and second layers 24, 26 that generate a thermal moment when heated primarily because of a large difference in the temperature coefficient of thermal expansion between the first and second materials. Thermal actuators for use in drop on demand emitters need only produce a short duration pulse of thermal moment, rather than a sustained deflection as may be required for a switch or a valve. Consequently, an effective alternate approach to construction the actuator layers is to use the time delay of heat transfer to cause a momentary expansion of one layer relative to another. Such a configuration is illustrated for a cantilever style actuator in FIG. 14.

Figure 14:
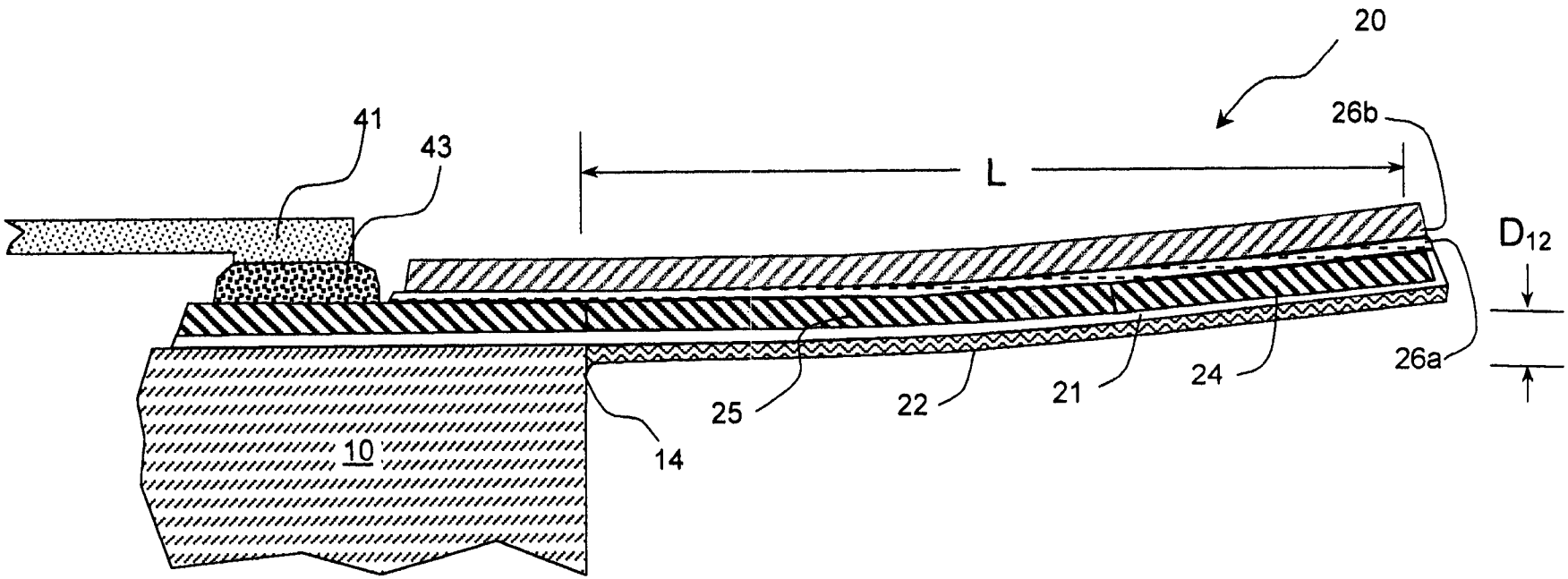
FIG. 14 is a side view of an alternate construction of a cantilevered element thermal actuator according to the present inventions.

FIG. 14 illustrates a multi-layer cantilevered element 20 which may operate primarily via temperature gradients among the layers. First layer 24 is constructed of a first material having a high coefficient of thermal expansion. In addition, the first material is electrically resistive and formed into a heater resistor 25 so that the application of electrical pulses directly heats the first layer. Second layer 26 is constructed of sub-layers 26*a* and 26*b*. Sub-layer 26*b* may be constructed of a material having a similar thermal expansion coefficient to the first material. The primary role of sub-layer 26*b* is to provide a stiff backing to the cantilever, restraining the expansion of the heated first layer so that the thermal moment is forceful and the actuator bends in a direction perpendicular to its elongation direction. In some preferred embodiments of the present inventions, sub-layer 26*b* may be constructed of the same material, the first material, used for the first layer.

In the configuration of FIG. 14, second layer 26 is attached to the uppermost side of first layer 24. The second side of first layer 24 is uppermost in FIG. 14 whereas it was lowermost in the beam element configuration of FIGS. 13(*a*) and 13(*b*). The first side of first layer 24 is the side towards the greatest linear expansion of the multi-layered thermal actuator, i.e., towards the side of outside curvature when actuated to the second position. The second side of first layer 24 is the side towards the inside curvature when the actuator has moved to the second position. The first side of first layer 24 is also towards the side of the multi-layer thermo-mechanical element that is initially heated to the highest temperature.

Sub-layer 26*a* is a thermal barrier layer that controls heat transfer between the first layer and the sub-layer 26*b* of the second layer. During the time that is required for significant heat transfer to occur, a thermal moment will exist due to the expansion mismatch of layers 24 and 26*b*, based on their temperature differential. Then as the layers reach thermal equilibrium at an elevated, the thermal moment will largely disappear if the coefficients of thermal expansion of the first and second layers are substantially equal.

Third layer 22 in FIG. 14 is attached to the cantilevered element on the first side of first layer 24 for the purpose of protecting the working fluid adjacent the heated layer 24 from excessive temperatures. Sub-layer 26*a* and third layer 22 both are designed to manage heat transfer away from first layer 24. In the case of sub-layer 26*a*, the thermal conductivity and thickness are selected to provide the necessary timing for the preservation of the thermal moment required by the drop forming processes. For the case of third layer 22, the thermal conductivity and thickness are selected to allow for sufficient heat transfer to the sub-layers 26*a*, 26*b* of second layer 26 and to the substrate 10, so the temperature applied to the working liquid adjacent third layer 22 is not so high as to cause degradation or vaporization of components of the liquid.

The Young's modulus of the third material is preferably low so as not to overly restrain elongation and bending of the first layer from the first side. The Young's modulus of the thermal barrier sub-layer 26*a* may be comparable to that of sub-layer 26*b* thereby contributing to the stiffening and constraining functions provided by the second layer 26.

A thin passivation layer 21 is illustrated positioned between first layer 24 and third layer 22. A passivation layer 21 may be desirable for purposes of chemical or electrical isolation of the first layer, for fabrication reasons, or to promote adhesion of the third material. The third layer is needed to delay heat transfer from the hottest areas of the first layer 24 to the working liquid. The third layer may not be formed everywhere that the working liquid may impinge first layer 24. Hence, passivation layer 21, underlying third layer 22, may provide any additional isolation of the first material needed that is not achieved by application of the third layer. Alternatively, a single material having low thermal conductivity and Young's modulus may provide the passivation function and heat transfer delay function performed by layers 21 and 22. And further, the third layer 22 may be formed immediately adjacent first layer 24, as illustrated in FIGS. 13(*a*) and 13(*b*), and then over-coated with a passivation layer. All of these alternative configurations are contemplated as embodiments of the present inventions.

For a variety of practical considerations, including liquid chemical safety, temperature limits of organic material components used in working liquids and in device fabrication, upper temperature limits for hot spots are likely to be in the range of 200° C. to 350° C. Water is the most common solvent in working liquids used with MEMS devices, primarily because of environmental safety ease-of-use. Many large organic molecules, such as dyes used for ink jet printing, will decompose at temperatures above 300° C. Most organic materials used as adhesives or protective coatings will decompose at temperatures above 400° C.

On the other hand, the deflection force that may be generated by a practically constructed cantilevered element thermal actuator is directly related to the amount of pulsed temperature rise that can be utilized. This temperature increase is directly related to the nominal power density that is applied to the actuation resistors, first and second resistor segments 62 and 64 in FIG. 5, for example. Typically, 50° C. of temperature rise would be a minimum level to provide a useful amount of mechanical actuation in a MEMS-based thermal actuator. More preferably, 150° C.–200° C. of pulsed temperature increase is desirable for thermal actuators used in liquid drop emitters such as ink jet printheads.

The inventors of the present inventions have found that the peak temperatures reached by the surface of a thermal actuator in contact with a working liquid may be reduced significantly by coating the hottest areas of the actuator with a thin material having a very low thermal conductivity. Examples of low thermal conductivity materials are polyimides, parylenes, polytetrafluoroethylene (PTFE, teflon), and liquid crystalline polymers. Some of the relevant properties of these materials are given in Table 1. Also given in Table 1 are the properties of several additional materials for purposes of discussion and comparison. The values given in Table 1 are representative of the materials as reported in the technical and commercial literature. Different fabrication methods may produce materials with substantially different values for a given physical property in Table 1.

The inventors of the present inventions have calculated the thermal and deflection responses of thermal actuators constructed according to the present inventions. Results of these calculations are plotted in FIGS. 15–17. A cantilevered element thermal actuator, as illustrated in FIG. 14, was used to calculate the plots of temperatures and displacements versus time shown. A rectangular cantilevered element having an extended length, L=80 $\mu$m and width, W=12.4 $\mu$m was assumed for the calculations. A heater resistor portion of first layer 24 was configured to heat the 45 $\mu$m nearest to the anchor wall 14, as is illustrated by resistor portion 25 in FIG. 14. An energy pulse having total energy of 1.4 $\mu$J was applied in a uniform energy pulse of duration 1 $\mu$sec.

For all of the calculations illustrated in FIGS. 15–17 the cantilevered element 20 layers were constructed of materials and thicknesses, $h_j$, as follows:

first layer 24, TiAl material $h_{24}$=1.5 $\mu$m;
second layer 26 sub-layer 26*a*, $SiO_2$, $h_{26a}$=0.5 $\mu$m;
second layer 26 sub-layer 26*b*, SiC, $h_{26b}$=1.3 $\mu$m;
passivation layer 21, $SiO_2$, $h_{21}$=0.2 $\mu$m.

Figure 15:
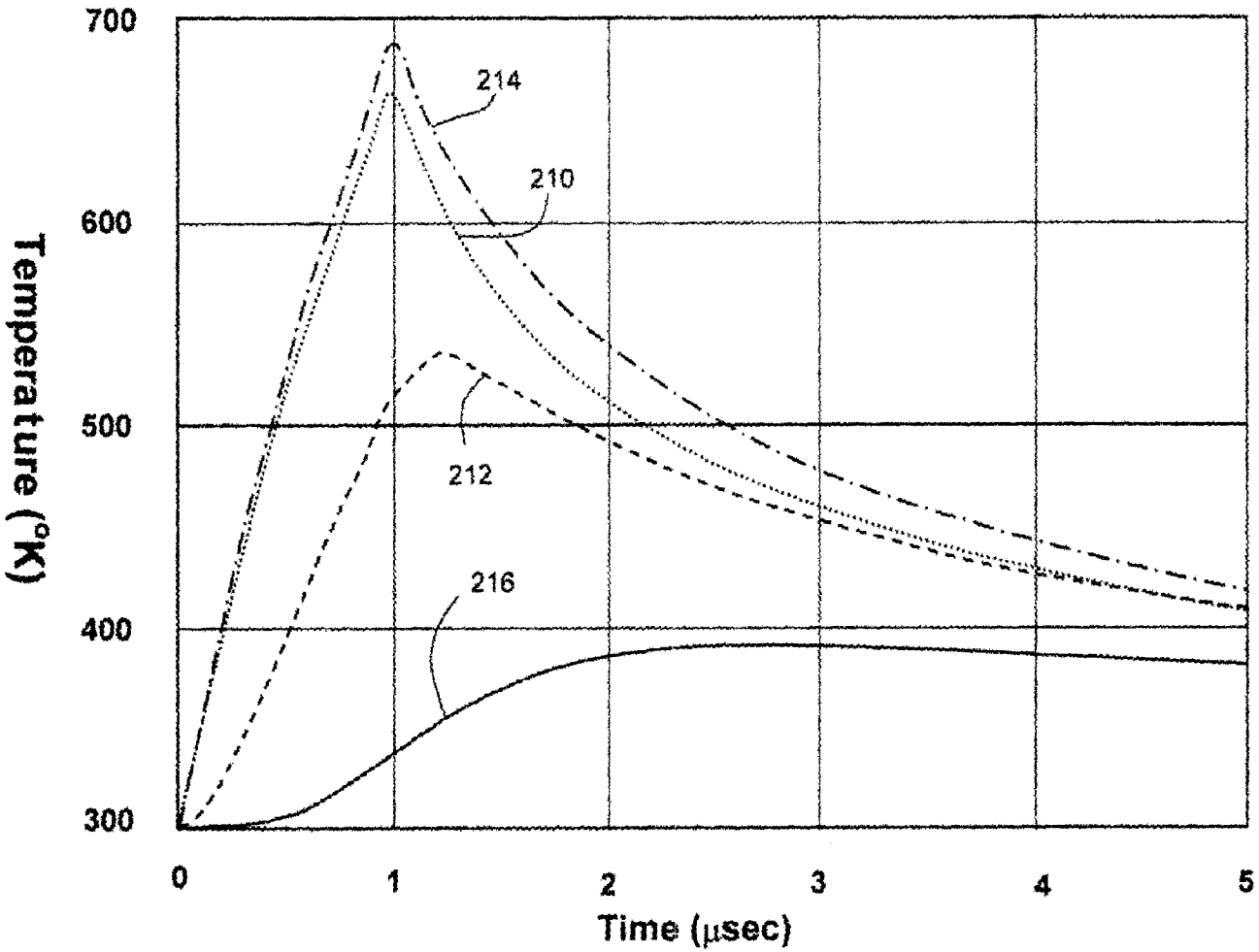
FIG. 15 shows calculated plots of the temperature versus time after the application of a heat pulse for a thermal actuator with and without a third layer of low thermal conductivity material according to the present inventions.
Figure 16:
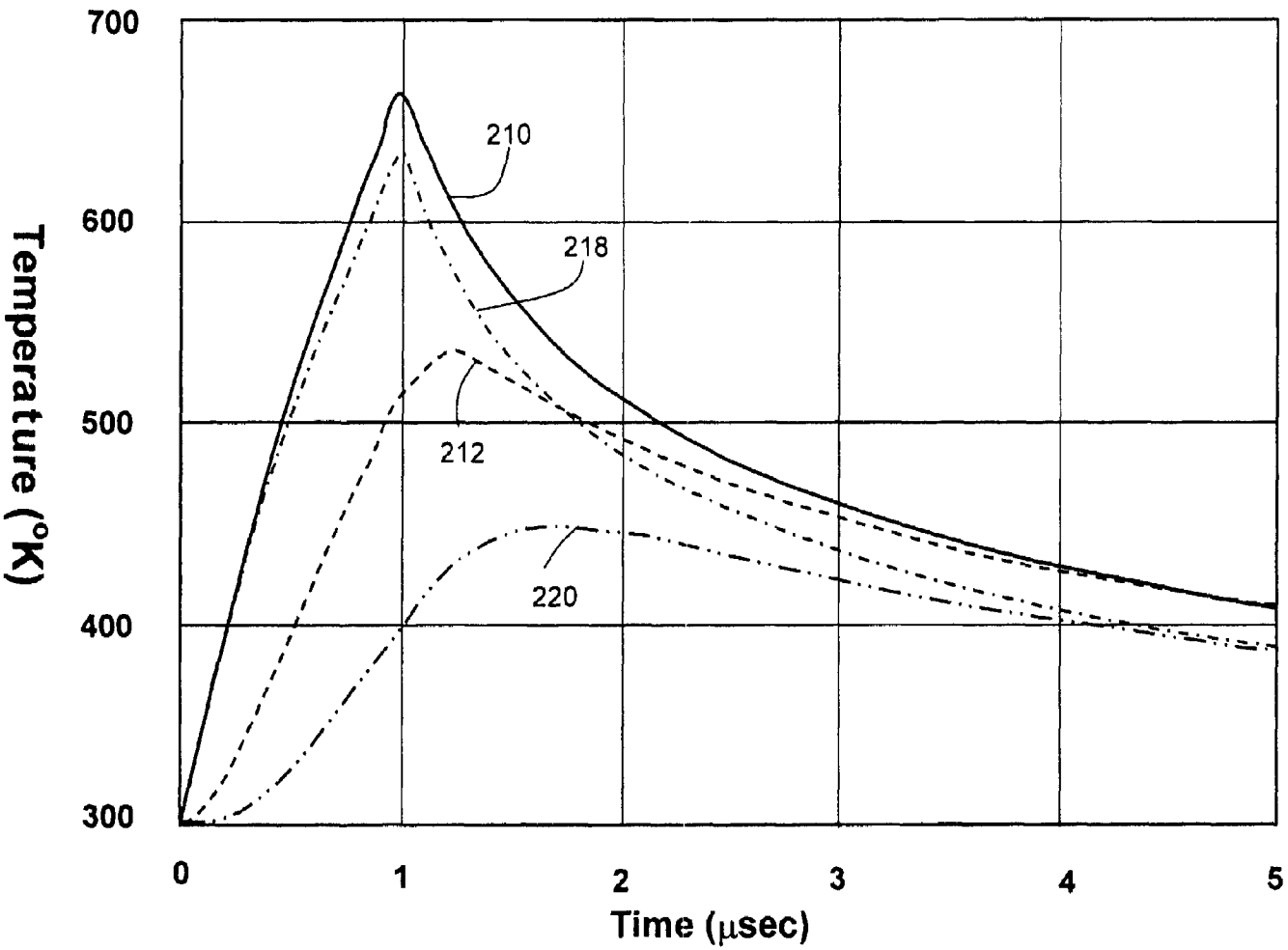
FIG. 16 shows for comparison purposes calculated plots of the temperature versus time after the application of a heat pulse for a thermal actuator with a third layer of high thermal conductivity material which is not according to the present inventions.
Figure 17:
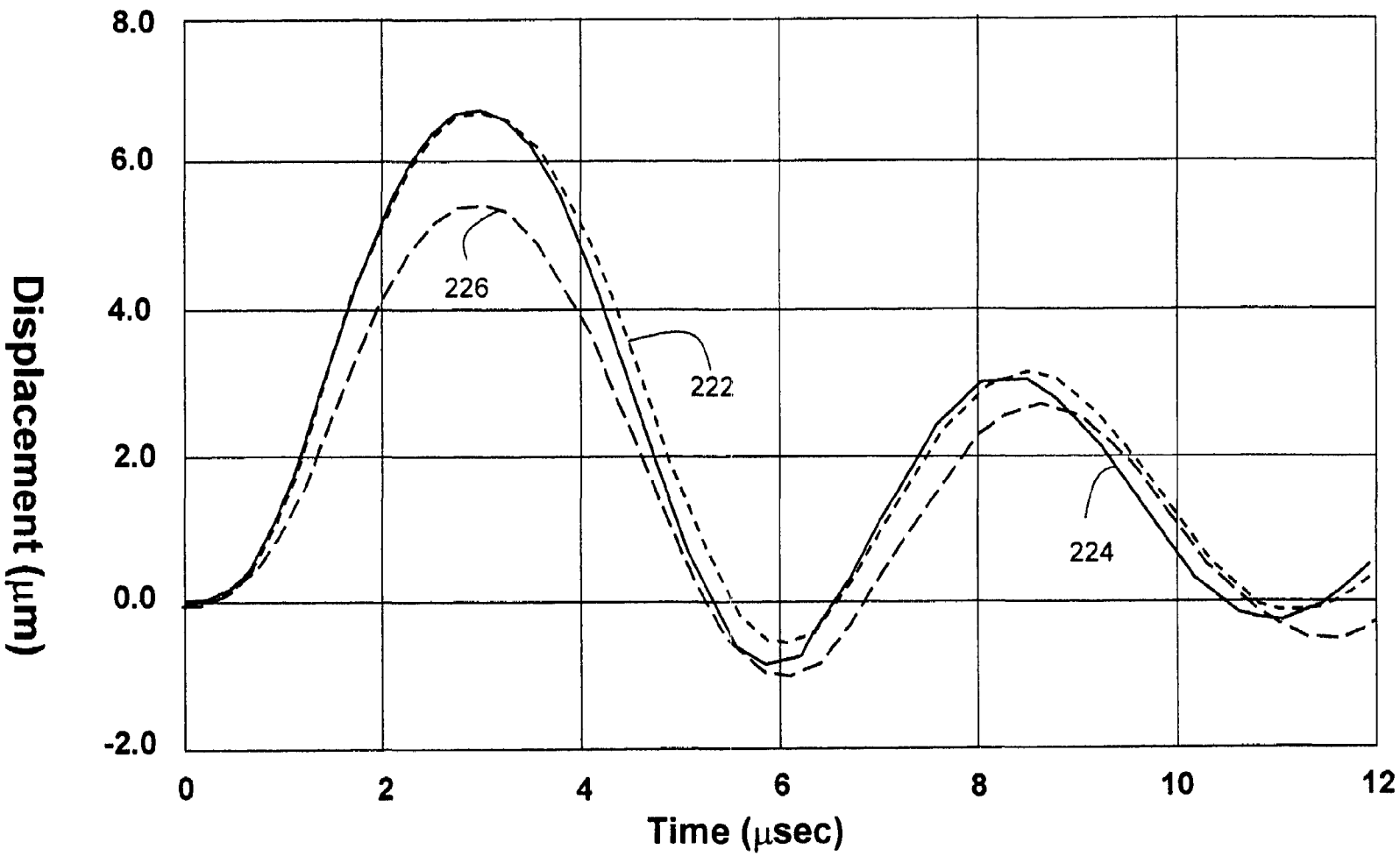

Third layer 22 was constructed of third materials and thicknesses, $h_{22}$, as follows for each of the plotted curves in FIGS. 15–17:

no third layer, curves 210, 212 and 224 in FIGS. 15–17;
teflon (PTFE) third layer 22, $h_{22}$=0.3 $\mu$m, curves 214, 216, and 222 in FIGS. 15 and 17;
gold (Au) third layer 22, $h_{22}$=0.5 $\mu$m, curves 218, 220, and 226 in FIGS. 16 and 17.

TABLE 1

| Material | E, Young's modulus (GPa) | k, thermal conductivity (W/(m ° K)) | α, TCE ($10^{-6}$) | ρ, density (Kg/m$^3$) | σ, Poisson's ratio | C, specific heat (J/kg ° K) | melting point (° C.) |
|---|---|---|---|---|---|---|---|
| polyimide | 2.5–9 | .12–0.3 | 20–55 | 1420 | 0.34 | 1100 | 400 |
| parylene | 3.2 | 0.08 | 35 | 1290 | 0.4 | 720 | 280 |
| PTFE | 0.2–0.4 | 0.2–0.28 | 80 | 2200 | 0.46 | 1170 | 335 |
| LCP | 2.26 | 0.3 | 17 | 1400 | 0.4 | 900 | 315 |
| Au, gold | 79 | 300 | 14 | 19200 | 0.42 | 128 | 1065 |
| Si | 110–165 | 150 | 2.6 | 2330 | 0.17 | 710 | 1700 |
| $SiO_2$ | 74 | 1.1 | 0.5 | 2200 | 0.17 | 710 | 1700 |
| $Si_3N_4$ | 170 | 2 | 1.55 | 3100 | 0.24 | | |
| PECVD SiC | 320 | 150 | 1.5 | 3200 | 0.24 | | |
| $TiAl_3$ | 188 | 40 | 15.5 | 3320 | 0.34 | | |

Considering first FIG. 15, the calculated temperature versus time is plotted for four situations. The plots commence with the beginning of a heat energy pulse applied to first layer 24. Curve 210 shows the calculated temperature within first layer 24, i.e. within the 1.5 μm TiAl material layer. The temperature within this layer rises steadily during the applied 1 μsec energy pulse, reaching a temperature of ~660° K before beginning to cool. For this calculation, the cantilevered element does not have a third layer 22; hence this configuration is not according to the present inventions. Curve 212 shows the temperature at the surface of the passivation layer 21, a 0.2 μm layer of $SiO_2$, which is in contact with the working liquid for this calculated configuration. The temperature of this layer surface peaks at ~530° K, (~260° C.), at ~1.2 μsecs as heat diffuses from the first layer 24 into the passivation layer 21. Subjecting the working fluid to temperatures of this magnitude may cause degradation of components or even vaporization of components of the working liquid.

Vaporization of superheated liquids is a complex phenomenon that depends, at least, on fluid properties, heated surface properties, the time rate of change of the temperature, and the spatial gradient of temperature through the superheated layer of fluid involved. Under the condition of very short duration heating found in thermal actuator drop on demand devices, vaporization usually occurs well above the "normal boiling point", for example, well above 100° C. for water. In all cases vaporization will occur when temperatures reach the critical point temperature, i.e. ~378° C. for water. During operation of a thermal ink jet device, "bubble jet", it is common to observe the boiling of water-based inks to occur between ~250° C. to 330° C., depending on the many factors noted previously.

The inventors of the present inventions have observed vapor bubble formation at the surface of thermal actuators operated with water under similar experimental conditions to the calculations plotted as curves 210 and 212, when drop emitters are pulsed at frequencies above ~2 kHz. Drop ejection cannot be reliably sustained during high frequency, repeated pulsing, under the calculated conditions, because the baseline temperatures of the thermal actuator and the working fluid near the actuator rise in addition to the passivation layer 21 high surface temperature caused by each activation pulse. Consequently, it is desirable to substantially reduce the surface temperature so that spontaneous vaporization of superheated working liquid does not occur. Addition of a heat delaying third layer 22 has been found to provide the necessary control of surface temperatures for reliable operation.

Temperature versus time calculations for a cantilevered element having a 0.3 μm PTFE (teflon) third layer 22 are plotted in FIG. 15 as curves 214 and 216. Curve 214 shows the calculated temperature within first layer 24, curve 216 shows the temperature at the surface of a 0.3 μm teflon third layer 22. The first layer 24 peak temperature at the completion of the 1.4 μJ, 1 μsec energy input pulse, is somewhat higher than for the device without a third layer (curve 210 in FIG. 15). This occurs because third layer 22 prevents heat transfer out of first layer 24 into the working liquid during the initial 1 μsec period of energy input. Curve 216 shows the effectiveness of the teflon third layer 22 in lowering the temperature applied to the working liquid. The peak temperature is only ~390° K (~120° C.), well below the temperatures at which vaporization is observed for short duration heating for aqueous liquids. The curve 212 of passivation layer 21 (0.2 μm of $SiO_2$) shows approximately the temperature of the inner surface of the teflon third layer 22 and curve 216 shows the outer surface of third layer 22. The difference between these curves further illustrates the successful delaying of the heat transfer from heated first layer 24 (curve 214) to the working liquid at the adjacent surface (curve 216), so that the working liquid is not subjected to excessive temperatures.

The curves in FIG. 16 are calculations for a cantilevered element having a gold, i.e. high thermal conductivity material, third layer 22. Curves 210 and 212 are for a cantilevered element without a third layer 22 within the first layer 24 and at the surface of the passivation layer 21, the same temperature versus time calculations as were discussed with respect to FIG. 15. Curves 218 and 220 show temperature versus time calculation for a cantilever with a 0.5 μm gold third layer 22. This configuration is not according to the present inventions. The use of gold for the third material departs from the present inventions because gold has a high thermal conductivity (~300 W/(m ° K)) and a high value of the Young's modulus (~79 GPa).

Curve 220, the calculated temperature at the surface of gold third layer 22, shows a substantial reduction in the peak temperature at the interface with the working liquid, ~175° C., versus ~260° C. for a bare passivation layer 21 surface, curve 212. This amount of temperature reduction, while significant, may not provide enough latitude for increases in baseline temperatures when high frequency repetitious pulsing is needed. In addition, the peak temperature reached by the first layer is also reduced by ~30° C.

Other consequences of lowered peak temperatures in first layer 24, and high Young's modulus when gold is used as a third layer 22 material, may be understood from the calculated actuator deflection versus time plots shown in FIG. 17. Curve 224 shows the calculated deflection of the free end 27 of a cantilevered element having no thermal time delaying third layer 22, when subjected to a 1.4 μJ, 1 μsec heat pulse as described above. Curve 222 shows the calculated deflection versus time result when a 0.3 μm teflon third layer 22 is employed. No loss of deflection magnitude, and importantly, rise time, is incurred with the addition of the teflon third layer 22. The comparable shapes of the deflection versus time profiles for these two configurations means that drop emission characteristics will not be affected while, achieving the great reduction in actuator surface temperature shown in FIG. 15 (curve 216 versus curve 212).

Curve 226 in FIG. 17 shows the deflection versus time calculation for the configuration having a 0.5 μm gold third layer. The peak deflection amplitude is reduced ~20% and, more importantly, the velocity of the actuator rise, is significantly reduced. The addition of the gold layer will cause the drop emission to have reduced quality, specifically, less drop volume for the input energy (1.4 μJ) and lower velocity of emitted drops.

Ideally, the material chosen for the third layer 22 function should have the lowest practical thermal conductivity and Young's modulus. Such characteristics allow the thinnest layer to provide the needed thermal barrier to the working liquid, while not diminishing the mechanical performance of the actuator. Organic polymer materials, as a class, provide the preferred combination of characteristics, except that many polymers cannot withstand high temperatures without degradation themselves. The polymer families listed in Table 1: parylene, PTFE, polyimide, and LCP are examples of materials that are used successfully in microelectronic device production and have reasonably high working temperatures. This list is not intended to be inclusive of all organic polymer materials which could be used as third materials for third layer 22 according to the present inventions.

It may be seen from Table 1 that over the four high temperature polymer families listed, the thermal conductivity ranges from a low value of ~0.08 W/(m ° K) for parylene up to ~0.3 W/(m ° K) for polyimide or LCP (liquid crystalline polymer) and ~0.4 W/(m ° K) for PTFE. Therefore, a third layer 22 thickness of ~0.1 μm of parylene could be expected to provide approximately the same thermal time delay as a 0.3 μm layer of polyimide or LCP and a 0.4 μm layer of PTFE. These values are well below the lowest value of the inorganic materials listed, ~1.1 W/(m ° K) for $SiO_2$.

Young's modulus values for the polymers listed range from a low of ~0.3 GPa for PTFE up to ~9 GPa for polyimide. The Young's modulus range for polymers may be seen to be well below that of the inorganic materials used for other layers of the thermal actuator, ~74 GPa ($SiO_2$) to 500 GPa (SiC).

The somewhat complex effect of materials properties on the performance of a multi-layered thermal actuator may be explored by calculating the coefficient of the thermal moment, c. For example, for the case of a cantilevered element thermal actuator such as that illustrated in FIG. 14, the deflection, $D_{12}$, of the free end in thermal equilibrium is given approximately by Equation 1:

$$D_{12} \approx c\Delta T\frac{L^2}{2}, \tag{1}$$

where $D_{12}$ is the deflection distance from a first position at a base temperature to a second position at an elevated temperature, ΔT is the temperature increase above the base temperature, L is the length of the cantilevered element 20, and c ΔT is termed the "thermal moment".

For a given cantilever length and temperature increase, the differences in deflection, $D_{12}$, that will occur for multi-layered cantilevered elements of various designs, is captured by c, the coefficient of thermal moment. The following equations define the coefficient of thermal moment for a long and relatively thin beam constructed of laminations of different materials.

$$c = \frac{3\sum_{j=1}^{N}\frac{E_j(y_j^2 - y_{j-1}^2)(\alpha - \alpha_j)}{1-\sigma_j}}{2\sum_{j=1}^{N}\frac{E_j[(y_j - y_c)^3 - (y_{j-1} - y_c)^3]}{1-\sigma_j}}, \tag{2}$$

where $$\alpha = \frac{\sum_{j=1}^{N}\frac{\alpha_j E_j h_j}{1-\sigma_j}}{\sum_{j=1}^{N}\frac{E_j h_j}{1-\sigma_j}}, \tag{3}$$

and

-continued $$y_0 = 0,\ y_j = \sum_{k=1}^{N} h_k,\ y_c = \frac{\sum_{j=1}^{N}\frac{1}{2}\frac{E_j(y_j^2 - y_{j-1}^2)}{1-\sigma_j^2}}{\sum_{j=1}^{N}\frac{E_j h_j}{1-\sigma_j^2}}. \tag{4}$$

The parameters j, in Equations 2–4 refer to the j layers, in order, in a multi-layer beam being analyzed. Using the same parameters for thicknesses as were used to calculate the curves in FIGS. 15–17 and the configuration of FIG. 14, the five layers (N=5) are thus: j=1, third layer 22; j=2, passivation layer 21, 0.2 μm of $SiO_2$; j=3, first layer 24, 1.5 μm of TiAl; j=4, second layer 26 sub-layer 26*a*, 0.2 μm of $SiO_2$; j=5, second layer 26 sub-layer 26*b*, 1.3 μm of SiC. $\alpha_j$, $E_j$, $h_j$, and $\sigma_j$ are the coefficients of thermal expansion (CTE), the Young's modulus, the thickness, and the Poisson's ratio for the jth layer, respectively. α is the effective coefficient of thermal expansion for the multi-layer beam as a whole. $y_c$ is the position of the mechanical center line of the bending beam.

The primary influence of the third layer 22 in the coefficient of thermal moment, c, is through its thickness $h_1$ and Young's modulus $E_1$. Equations 2–4 were evaluated to calculate c, as a function of these two parameters while fixing the thicknesses and materials properties of the other four layers. For these calculations constant values for the coefficient of thermal expansion, $\alpha_1=11\times10^{-6}$, and Poisson's ratio, $\sigma_1=0.46$, were used. These values are those of PTFE but are not too different from the values of the other organic polymer family materials in Table 1.

Figure 18:
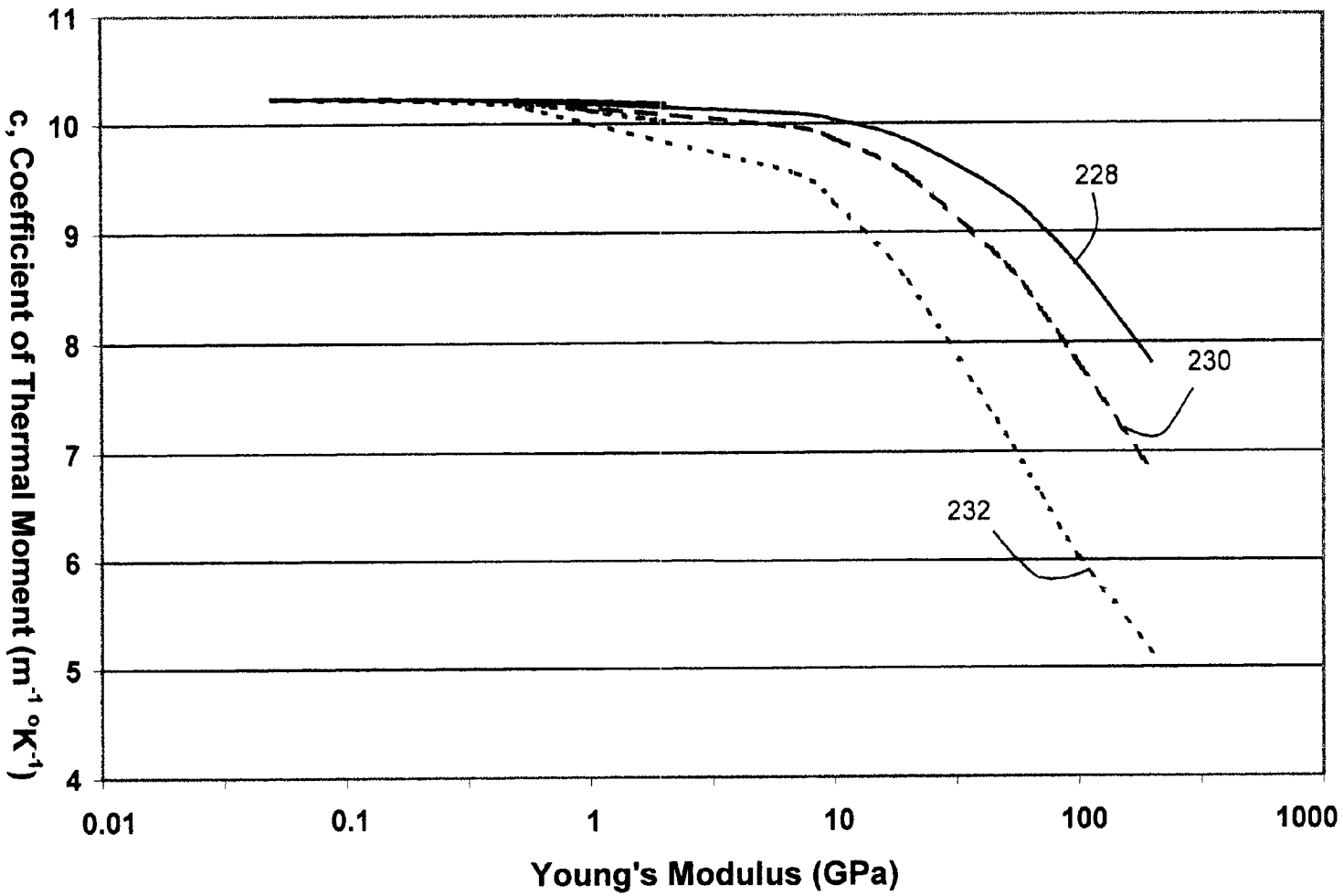
FIG. 18 shows calculated plots of the coefficient of thermal moment for thermo-mechanical actuators having third layers having different thicknesses and values of Young's modulus for the third material.

Calculated values for c, the coefficient of thermal moment, are plotted in FIG. 18 for third layer 22 thicknesses $h_1$=0.3 μm (curve 228), $h_1$=0.5 μm (curve 230) and $h_1$=1.0 μm (curve 232) versus Young's modulus over the range $E_1$=0.05 GPa to 200 GPa It may be understood from the curves in FIG. 18 that the coefficient of thermal moment, c, hence the magnitude of the deflection caused by a given temperature increase, decreases as the third layer 22 material becomes stiffer, i.e. as the Young's modulus increases. This effect is more pronounced as the thickness of third layer 22 is increased from 0.3 μm to 1.0 μm. The thickness selected for third layer 22 must be selected together with the thermal conductivity to achieve the desired thermal delay to keep the surface temperature next to the working liquid below a value needed for reliable operation. Thus, while a thicker material (one having a higher thermal conductivity) may be selected, the thermomechanical performance will be reduced if the Young's modulus is too high.

In general, it is preferred that the Young's modulus of the third material be less than 10 GPa, or less than 10% of the Young's modulus of the first layer 24 material. $E_3$=188 GPa for the TiAl used in these examples, so $E_1$<~19 GPa by comparison to the nearby first layer 24 is preferred for third materials for this example. It is further preferred that the thermal conductivity of the third material $k_{22}$ be less than 1 W/(m ° K) so that the thickness does not need to be greater than a few tenths of microns in order to achieve thermal delay times of a few microseconds. The polymer families listed in Table 1 are good candidate materials for constructing third layer 22. However, other materials meeting the criteria of low thermal conductivity, low Young's modulus and high melting temperature may also be selected. Fabrication process differences and cost are also important criteria. The inventors of the present inventions envision that many third material choices are acceptable to practice their inventions and do not imply any limitation to the materials listed in Table 1.

While much of the foregoing description was directed to the configuration and operation of a single drop emitter, it should be understood that the present invention is applicable to forming arrays and assemblies of multiple drop emitter units. Also it should be understood that thermal actuator devices according to the present invention may be fabricated concurrently with other electronic components and circuits, or formed on the same substrate before or after the fabrication of electronic components and circuits.

From the foregoing, it will be seen that this invention is one well adapted to obtain all of the ends and objects. The foregoing description of preferred embodiments of the invention has been presented for purposes of illustration and description. It is not intended to be exhaustive or to limit the invention to the precise form disclosed. Modification and variations are possible and will be recognized by one skilled in the art in light of the above teachings. Such additional embodiments fall within the spirit and scope of the appended claims.

Parts List

10 Substrate
11 upper liquid chamber
12 lower liquid chamber
13 gap between moveable element and chamber wall
14 cantilevered element anchor location
15 thermal actuator with a cantilevered element 20
16 lower liquid chamber curved wall portion
17 anchored portion of cantilevered element 20
20 cantilevered element
21 passivation layer
22 third layer
24 first layer
25 resistor portion of first layer 24
26 second layer
27 free end portion of cantilevered element
28 upper liquid chamber structure, walls and top cover
29 sacrificial layer
30 Nozzle
41 TAB lead
42 electrical input pad
43 solder bump
44 electrical input pad
45 solder bump
46 TAB lead
50 Drop
52 liquid meniscus
53 erratic drop emission
56 vapor bubbles of the working liquid
60 working liquid
62 first resistor segment
64 second resistor segment
66 current coupling segment
70 beam element
71 bending portion
72 lengthwise axis
73 central fluid displacement portion
74 narrowed central portion of the lower liquid chamber
75 simple linear resistor formed in first layer
76 gap between beam element 70 and chamber walls
77 anchored portion of beam element 70
78 first anchor wall
79 second anchor wall
85 thermal actuator with a beam element 70
90 support structure
92 evaporation apparatus for third material
93 bulk third material in evaporation apparatus
94 vapor of third material
95 insitu deposition process electrical control signal
96 manifold supply for solution or dispersion of third material
97 temporary nozzle plug during insitu third material deposition process
98 solution or dispersion of third material
99 inlet for solution or dispersion of third material
110 drop emitter unit having a cantilevered thermo-mechanical actuator 15
120 drop emitter unit having a beam therrno-mechanical actuator 85
200 electrical pulse source
300 Controller
400 image data source
500 Receiver

What is claimed is:

1. A liquid drop emitter comprising:

(a) a chamber, formed in a substrate, filled with a liquid and having a nozzle for emitting drops of the liquid;

(b) a thermo-mechanical actuator, extending into the chamber from at least one wall of the chamber, and having a movable element residing in a first position proximate to the nozzle;

(c) the movable element having a bending portion which bends when heated, the bending portion comprising a first layer having first and second sides, constructed of a first material having a high coefficient of thermal expansion, a second layer, attached to the second side of the first layer, and a third layer, attached to the first side of the first layer, constructed of a third material having a low thermal conductivity and a low Young's modulus;

(d) apparatus adapted to apply heat pulses to the first layer of the bending portion causing a thermal expansion of the first layer relative to the second layer, rapid deflection of the movable element to a second position and ejection of a liquid drop, without causing substantial degradation or vaporization of the liquid.

2. The liquid drop emitter of claim 1 wherein the liquid drop emitter is a drop-on-demand ink jet printhead and the liquid is an ink for printing image data.

3. The liquid drop emitter of claim 1 wherein the movable element is configured as a cantilever having a free end residing in a first position proximate to the nozzle.

4. The liquid drop emitter of claim 1 wherein the first material is electrically resistive and the apparatus adapted to apply a heat pulse includes a resistive heater formed in the first layer.

5. The liquid drop emitter of claim 4 wherein the first material is titanium aluminide.

6. The liquid drop emitter of claim 1 wherein the second layer is constructed of a second material which is an inorganic dielectric having a low coefficient of thermal expansion.

7. The liquid drop emitter of claim 1 wherein the second layer is a laminate comprised of a first sub-layer of the first material and a second sub-layer of a second material having a low thermal conductivity, the second sub-layer being positioned between the first layer and the first sub-layer.

8. The liquid drop emitter of claim 1 wherein the first material has a first Young's modulus, $E_{24}$, the third material has a third Young's modulus, $E_{22}$, selected so that $E_{22}$ is less than 10% of $E_{24}$, $E_{22}<(0.1\times E_{24})$.

9. The liquid drop emitter of claim 1 wherein the third material has a third Young's modulus, $E_{22}$, which is less than 10 GPa, $E_{22}<10$ GPa.

10. The liquid drop emitter of claim 1 wherein the third material has a third thermal conductivity, $k_{22}$, which is less than 1 W/(m ° K), $k_{22}<1$ W/(m ° K).

11. The liquid drop emitter of claim 1 wherein the third material is an organic polymer having a melting point temperature greater than 250° C.

12. The liquid drop emitter of claim 11 wherein the third material is a polyimide, fluorocarbon, parylene, or liquid crystalline polymer.

13. The liquid drop emitter of claim 12 wherein the third material is a polytetrafluoroethylene.

14. The liquid drop emitter of claim 1 wherein the movable element is partially formed in the substrate, then released from the substrate, and the third layer is formed thereafter.

15. The liquid drop emitter of claim 14 wherein the third layer is formed, at least in part, by evaporative deposition of the third material.

16. The liquid drop emitter of claim 14 wherein the third layer is formed, at least in part, by an insitu process using the apparatus adapted to apply heat pulses to the first layer.

17. The liquid drop emitter of claim 1 wherein the third layer is in contact with the liquid.

18. The liquid drop emitter of claim 1 wherein the third layer has a third thickness, $h_{22}$, which is less than 1 micron, $h_{22}<1$ $\mu$m.

19. The liquid drop emitter of claim 1 wherein the liquid includes a vaporizable component and the third layer has a thickness, $h_{22}$, selected so that the liquid temperature remains below the temperature required for film boiling of the vaporizable component.

20. The liquid drop emitter of claim 19 wherein the vaporizable component is water.

21. A liquid drop emitter comprising:

(a) a chamber, formed in a substrate, filled with a liquid and having a nozzle for emitting drops of the liquid;

(b) a thermo-mechanical actuator, having a beam element extending from opposite first and second anchor walls of the chamber and a central fluid displacement portion residing in a first position proximate to the nozzle;

(c) the beam element having bending portions adjacent the first and second anchor walls that bend when heated, the bending portions comprising a first layer having first and second sides, constructed of a first material having a high coefficient of thermal expansion, a second layer, attached to the second side of the first layer, and a third layer, attached to the first side of the first layer, constructed of a third material having a low thermal conductivity and a low Young's modulus; and (d) apparatus adapted to apply heat pulses to the bending portions resulting rapid deflection of the central fluid displacement portion to a second position, ejection of a liquid drop, without causing substantial degradation or vaporization of the liquid.

22. The liquid drop emitter of claim 21 wherein the liquid drop emitter is a drop-on-demand ink jet printhead and the liquid is an ink for printing image data.

23. The liquid drop emitter of claim 21 wherein the first material is electrically resistive and the apparatus adapted to apply a heat pulse includes a resistive heater formed in the first layer.

24. The liquid drop emitter of claim 23 wherein the first material is titanium aluminide.

25. The liquid drop emitter of claim 21 wherein the second layer is constructed of a second material which is an inorganic dielectric having a low coefficient of thermal expansion.

26. The liquid drop emitter of claim 21 wherein the second layer is a laminate comprised of a first sub-layer of the first material and a second sub-layer of a second material having a low thermal conductivity, the second sub-layer being positioned between the first layer and the first sub-layer.

27. The liquid drop emitter of claim 21 wherein the first material has a first Young's modulus, $E_{24}$, and the third material has a third Young's modulus, $E_{22}$, selected so that $E_{22}$ is less than 10% of $E_{24}$, $E_{22}<(0.1\times E_{24})$.

28. The liquid drop emitter of claim 27 wherein the third material is a polyimide, fluorocarbon, parylene, or liquid crystalline polymer.

29. The liquid drop emitter of claim 21 wherein the third material has a third Young's modulus, $E_{22}$, which is less than 10 GPa, $E_{22}<10$ GPa.

30. The liquid drop emitter of claim 29 wherein the third material is a polytetrafluoroethylene.

31. The liquid drop emitter of claim 21 wherein the third material has a third thermal conductivity, $k_{22}$, which is less than 1 W/(m ° K), $k_{22}<1$ W/(m ° K).

32. The liquid drop emitter of claim 21 wherein the third material is an organic polymer having a melting point temperature greater than 250° C.

33. The liquid drop emitter of claim 21 wherein the movable element is partially formed in the substrate, then released from the substrate, and the third layer is formed thereafter.

34. The liquid drop emitter of claim 33 wherein the third layer is formed, at least in part, by evaporative deposition of the third material.

35. The liquid drop emitter of claim 33 wherein the third layer is formed, at least in part, by an insitu process using the apparatus adapted to apply heat pulses to the first layer.

36. The liquid drop emitter of claim 21 wherein the third layer is in contact with the liquid.

37. The liquid drop emitter of claim 21 wherein the third layer has a third thickness, $h_{22}$, which is less than 1 micron, $h_{22}1$ □m.

38. The liquid drop emitter of claim 21, wherein the liquid includes a vaporizable component and the third layer has a thickness $h_{22}$, selected so that the liquid temperature remains below the temperature required for film boiling of the vaporizable component.

39. The liquid drop emitter of claim 38 wherein the vaporizable component is water.

* * * * *